US008419011B2

(12) United States Patent
Gerlier et al.

(10) Patent No.: US 8,419,011 B2
(45) Date of Patent: Apr. 16, 2013

(54) DISPENSING VALUE SHEET STORE

(75) Inventors: André Gerlier, Sceiz (FR); Roberto Polidoro, Cologny (CH); Guillermo Garcia, Bossey (FR); Christian Voser, Geneva (CH)

(73) Assignee: MEI, Inc., Malvern, PA (US)

( * ) Notice: Subject to any disclaimer, the term of this patent is extended or adjusted under 35 U.S.C. 154(b) by 0 days.

(21) Appl. No.: 12/768,461

(22) Filed: Apr. 27, 2010

(65) Prior Publication Data

US 2010/0207316 A1 Aug. 19, 2010

Related U.S. Application Data

(62) Division of application No. 11/612,337, filed on Dec. 18, 2006, now Pat. No. 7,726,645.

(30) Foreign Application Priority Data

Dec. 19, 2005 (EP) ..... 05257808

(51) Int. Cl.
*B65H 1/00* (2006.01)

(52) U.S. Cl.
USPC ..... 271/145; 271/162; 221/152

(58) Field of Classification Search ..... 271/145, 271/162; 221/151–153; 194/351
See application file for complete search history.

(56) References Cited

U.S. PATENT DOCUMENTS

| | | | | |
|---|---|---|---|---|
| 4,275,667 | A * | 6/1981 | Hilton | 109/44 |
| 5,100,022 | A * | 3/1992 | Fukudome et al. | 221/198 |
| 5,224,731 | A | 7/1993 | Johnson | |
| 5,372,361 | A | 12/1994 | Isobe et al. | |
| 5,421,443 | A | 6/1995 | Hatamachi et al. | |
| 5,692,743 | A | 12/1997 | Yano et al. | |
| 5,700,003 | A | 12/1997 | Sung | |
| 5,730,271 | A | 3/1998 | Buchman et al. | |
| 5,752,696 | A * | 5/1998 | Nakatani et al. | 271/127 |
| 5,788,348 | A * | 8/1998 | Ramachandran et al. | 312/223.1 |
| 6,206,362 | B1 | 3/2001 | Tan et al. | |
| 6,592,118 | B2 | 7/2003 | Youn | |

(Continued)

FOREIGN PATENT DOCUMENTS

| | | |
|---|---|---|
| EP | 0 624 535 a1 | 11/1994 |
| EP | 0 798 246 A1 | 10/1997 |

(Continued)

OTHER PUBLICATIONS

Non-Final Office Action dated Jul. 18, 2011 of related U.S. Appl. No. 12/767,059.

*Primary Examiner* — Michael McCullough
(74) *Attorney, Agent, or Firm* — Mintz Levin Cohn Ferris Glovsky and Popeo, P.C.

(57) ABSTRACT

A value sheet store from which value sheets may be dispensed. The value sheet store includes a housing having an aperture from which value sheets are dispensed, and a shutter operable to block the aperture. The aperture may be at least partially defined by at least one roller. The shutter may be formed to interleave with the aperture to block the aperture. The shutter may also be formed to interleave with the roller. The value sheet store may be adapted to be removably engageable with a value sheet transporter for transporting sheets to or away from the store. The value sheet store may be configured so that the shutter blocks the aperture when the value sheet store blocks the aperture when the value sheet store and the transporter are not engaged and unblock the shutter when the value sheet store and the transporter are engaged.

7 Claims, 23 Drawing Sheets

U.S. PATENT DOCUMENTS

| | | | | |
|---|---|---|---|---|
| 6,672,579 | B2 | 1/2004 | Araki et al. | |
| 2004/0041333 | A1 | 3/2004 | Izumi et al. | |
| 2004/0155102 | A1 | 8/2004 | Bergeron et al. | |
| 2004/0188920 | A1 | 9/2004 | Washington et al. | |
| 2004/0251599 | A1 | 12/2004 | Kojima et al. | |
| 2004/0256787 | A1 | 12/2004 | Wada et al. | |
| 2005/0184447 | A1 | 8/2005 | Tsukamoto et al. | |
| 2007/0000752 | A1 * | 1/2007 | Yoshioka | 194/351 |

FOREIGN PATENT DOCUMENTS

| | | | |
|---|---|---|---|
| EP | 0 919 500 | A2 | 6/1999 |
| EP | 1 128 345 | A2 | 8/2001 |
| EP | 1 160 185 | A2 | 12/2001 |
| EP | 1 304 664 | A2 | 4/2003 |
| EP | 1 553032 | A1 | 7/2005 |
| GB | 2 039 264 | A | 8/1980 |
| GB | 2 137 177 | A | 10/1984 |
| GB | 2 360 510 | A | 9/2001 |
| JP | 59-217538 | | 12/1984 |
| JP | 05-246571 | | 9/1993 |
| JP | 08-157104 | | 6/1996 |
| WO | WO 92/20892 | | 11/1992 |
| WO | WO 01/23289 | A2 | 4/2001 |
| WO | WO 01/29786 | A1 | 4/2001 |

* cited by examiner 138
150
136
152
154
156

502
504
500
528
106
526
522
200
524
208
220
454
450
126
309
300
140
136
124
122
102
352
120
560
124
124
626
600
602
452
438
440
434
438
232
212
210
140
202
206
204
436
112
104

DISPENSING VALUE SHEET STORE

CROSS-REFERENCE TO RELATED APPLICATION(S)

This application is a divisional of U.S. Ser. No. 11/612,337, filed Dec. 18, 2006, which claims the benefit of foreign priority application filed in Europe, serial number 05257808.5, filed Dec. 19, 2005.

FIELD OF THE INVENTION

This invention relates to stores for sheets of value and, in particular, stores adapted to dispense such sheets. As used herein, "value sheets" refers to any sheets of value such as cheques, banknotes, coupons etc.

BACKGROUND OF THE INVENTION

A change giver or vending machine and machines of the type accept value sheets from a user and give change in the form of value sheets. Such machines are herein referred to as "banknote handlers" or "value sheet handlers". Value sheet handlers incorporate a number of different types of value sheet stores and means for judging the authenticity of value sheets received from users and returning value sheets to users in the form of change. Value sheet handlers include suitable means to transport value sheets from one location to another.

Importantly, value sheet handlers are geographically remote from the administrator of the machine. It will be appreciated that as the value sheet handler operates, the proportions of value sheets in the handler will vary. Therefore, the administrator needs to bring value sheets to the machine and remove value sheets from the machine.

This invention is primarily concerned with value sheet stores suitable for transporting value sheets to such a value sheet handler. The administrator may fill the store with a number of value sheets and the store and the handler are designed so that the store may be inserted into the handler. It is therefore necessary that the store be able to dispense value sheets to the value sheet handler. Such value sheet stores are referred to as "payouts".

There are a number of known methods by which a payout may dispense value sheets to a value sheet handler. In one such method, the value sheets are stored in the payout in a stack supported by a pressure plate. The pressure plate is biased so that a topmost value sheet of the stack is brought into contact with an uptake roller. The uptake roller rotates to transport the topmost value sheet of the stack out of the store.

This suffers from the disadvantage that value sheets adhere to one another due to friction and/or creasin and the action of the roller may transport more than a single value sheet out of the payout. Such a bundle of value sheets may cause jams in the value sheet handler or in the payout. In the remainder of this discussion, in the context of one or more value sheets being transported from a stack, the value sheets transported will be referred to as a "bundle" although it will be appreciated that in certain instances the bundle may comprise a single value sheet.

To minimise this problem, it is know to provide an additional set of rollers comprising a first and second transport roller which engage with the bundle. In one such example, the first transport roller engages a topmost value sheet of the bundle and the second transport roller engages the lowermost value sheet. Once the bundle is engaged by both rollers, the direction of rotation of the second transport roller will be reversed for a predetermined time. Through this action all value sheets except the topmost one will tend to be returned to the store. Usually, the first transport roller will have a greater coefficient of friction than the second transport roller so that when the second transport roller engages the topmost value sheet, the action of this roller will not displace the topmost value sheet.

This suffers from the disadvantage that where the bundle comprises at least two value sheets and the displacement between the value sheets is too large, the action of the second roller rotating in the reverse direction for a predetermined time will be insufficient to drive the lower value sheet back into the store, resulting in the bundle being further transported into the value sheet handler with the associated risk of jams.

A further problem exists, even when all but the topmost value sheet are removed from the bundle. Due to friction between the returning value sheets and those on the stack, value sheets may become crumpled in the stack which can cause a jam in the payout.

Jams involving value sheets generally require the intervention of a person with an associated cost. Furthermore, the machine may be inoperable until the jam is cleared, further increasing the cost of the jam.

It is therefore desirable to prevent jams caused by returning value sheets from the bundle to the stack.

SUMMARY OF THE INVENTION

According to a first aspect of the invention, a value sheet store and associated method of dispensing value sheets are provided wherein sheets are dispensed by removing a bundle of one or more sheets from a stack and all but one of the value sheets of the bundle are returned to the stack while increasing a distance between the stack and a dispensing means.

Where the bundle is supported by means other than the stack, relative movement of the stack will decrease an area of contact between the returning value sheets and the topmost value sheet of the stack, thereby reducing the likelihood of crumpling of the returning value sheets which may cause a jam.

The bundle may be removed in a direction substantially parallel to a plane defined by a topmost value sheet of the stack. Preferably, the stack is brought into contact with the dispensing means which includes an uptake roller and the bundle is dispensed from the stack by the uptake roller. When the value sheets are returned to the stack the distance between the stack and the dispensing means is increased by moving the stack away from the uptake roller.

The dispensing means may further include first and second transport rollers which act to transport the bundle away from the stack. Value sheets may be returned from the bundle to the stack by the action of the first and the second transport roller. The first transport roller may engage a topmost value sheet of the bundle while the second transport roller engages a bottommost value sheet of the bundle. During the return of value sheets to the stack, the second transport roller preferably rotates in a direction opposite to that of the first transport roller.

The stack of value sheets may be supported by a pressure plate and the stack may be moved by moving the pressure plate. Preferably, movement of the pressure plate is biased so that the stack is encouraged into engagement with the uptake roller and the movement of the pressure plate during a dispensing operation counteracts the bias.

A further aspect of the invention relates to a store for storing value sheets in a stack wherein the stack is moved during a dispensing operation which includes means for securing the stack. This is particularly useful when the store is being transported as movement during transport may otherwise cause misalignment of the value sheets stored in the stack.

If the stack is supported by a pressure plate which is moved during a dispensing operation, the securing means may anchor the pressure plate to prevent it from moving.

Alternatively, or additionally, pressure may be applied to the stack to secure it. Where the stack is sandwiched between a pressure plate and an overlying plate, pressure may be applied to the stack by moving the overlying plate in a direction towards the pressure plate. This may be achieved by a pivoting lever which engages with the overlying plate.

Where the store is adapted to be filled at one location and transported to a value sheet handler where the store is installed at the value sheet handler, the securing means is preferably operational during transport of the store. Therefore, the securing means may be disengaged when the store is accessed by the lifting of a lid and/or when the store is installed in a value sheet handler. Similarly, the securing means may be engaged when the lid is closed and/or when the store is removed from the value sheet handler.

A further aspect of the invention relates to a store for storing value sheets in a stack wherein the stack is moved during a dispensing operation which includes means for indicating to a user when the store contains more than a predetermined number of value sheets. As the stack is moved during a dispensing operation, it is possible to overfill the stack, leaving insufficient room for movement during a dispensing operation. An indicating means gives a signal to a user that the stack is too full, thereby avoiding value sheet jams which would otherwise occur.

Preferably, the store includes means for preventing securing of the store when the stack contains more than the predetermined number of value sheets. This will prevent a user from over-filling the stack and using the store in a configuration which can lead to value sheet jams and damage to the store.

Where the housing includes a lid, the store may include a stop operable between a first position, when the stack contains less than the predetermined number of value sheets, and a second position, when the stack contains more than the predetermined number of value sheets. The lid may include a protrusion which engages with the stop when in the second position, thereby preventing closing of the lid and securing of the store. The stop may be associated with the indicating means.

Preferably, the store includes a plate, overlying the stack, which engages with the indicator when the stack contains fewer than the predetermined number of value sheets. The engagement with the indicator moves it from a second position to a first position. If the stop is associated with the indicator, movement of the indicator may move the stop from its second position to its first position, thereby allowing closure of the lid.

Preferably the indicator is biased towards its second position so that when the plate is removed, the indicator will move to its second position.

According to a further aspect of the invention, a value sheet store and associated method of dispensing value sheets are provided wherein a bundle of one or more value sheets are transported from a stack and all but one of the value sheets of the bundle are returned to the stack and the remaining value sheet is dispensed, wherein a sensor determines the number of sheets in the bundle.

Value sheets may be removed from the bundle by the action of a first and a second transport roller. The first transport roller may engage a topmost value sheet of the bundle while the second transport roller engages a bottommost value sheet of the bundle. During the removal of value sheets from the bundle, the second transport roller may be stationary or may rotate at a different rate to the first roller. Preferably the second roller rotates in a direction opposite to that of the first roller and the removed value sheets are returned to the stack.

By detecting the number of value sheets in the bundle, the action of the first and/or the second roller can be altered when a single value sheet remains in the bundle. Preferably, the action of the first and second transport rollers is altered so as to remove the remaining value sheet from the stack. This avoids more than a single sheet being transported thereby avoiding jams. Furthermore, the action of the second roller on the topmost value sheet may be minimised thereby reducing wear on this value sheet.

According to a further aspect of the invention, a value sheet store is provided which includes at least one adjustable lateral guide to accommodate value sheets of varying sizes.

Preferably the store includes two adjustable lateral guides to accommodate value sheets of varying length and width.

At least one of the lateral guides may include an upper portion articulated with respect to a lower portion. This provides a user with access to the store without the necessity of moving the guide. Preferably, movement of the articulated upper portion is biased.

A further aspect of the invention extends to a store for value sheets which includes a housing having side walls and a lid, wherein at least a portion of one of the sidewalls is integrally formed with the lid so that when the lid is removed, the portion of the sidewall is removed therewith. This increases a user's access to the store, increasing the ease with which the value sheets can be removed from, and inserted into, the store. This also aids in maintenance of the store, providing a maintenance person which greater ease of access to the components of the store.

In a further aspect of the invention a value sheet store is provided having a housing comprising at least one wall describing a plane and a handle attached to the housing by at least one hinge lying substantially in the plane of the wall.

If two stores having respective handles located in the plane of respective walls are carried together, they may be orientated so that the respective walls abut one another. This increases the ease with which the two stores may be transported.

Preferably the two respective walls are formed with complimentary means such as recesses and abutments so that the stores do not move relative to one another while being transported. This further increases the ease of transport of the two stores as relative movement can render the stores unwieldy.

A further aspect of the invention relates to a value sheet store from which value sheets may be dispensed including a housing having an aperture from which the value sheets are dispensed wherein the store further includes a shutter operable to block the aperture. Preferably, the shutter is formed to engage with the aperture.

The shutter prevents unauthorised access to the value sheets. This is particularly useful when the store is used to transport value sheets.

Where the store is adapted to be filled at one location and transported to a value sheet handler where the store is installed at the value sheet handler, the shutter preferably blocks the aperture during transport. Preferably, the insertion of the store into the value sheet handler causes the shutter to unblock the aperture.

To further disallow access to the stack via the aperture, the store may include means preventing removal of the store from the value sheet handler unless the shutter blocks the aperture.

This will prevent removal of the store where one or more value sheets have become lodged in the aperture. This is useful where the person who transports the store is not sufficiently trusted to be allowed access to the value sheets. Preferably, in this situation, a second manner of removing the store is provided so that the jam can be cleared and the store removed for refilling.

According to a further aspect, the invention provides for a store for storing value sheets in a stack and means for calculating a height of the stack. Preferably, the stack is supported by a pressure plate and the calculation is based on measuring a distance traversed by the pressure plate. The distance may be the difference between a reference point and the point at which the stack is engaged by a dispensing means.

Preferably, the store includes a plate overlying the stack orientated at an opposite end of the stack to the pressure plate and the pressure plate moves the stack from the reference point to a point where the stack engages the overlying plate.

This is useful for estimating the number of value sheets contained in the stack so that a user may be notified when the stack contains fewer than a predetermined number of value sheets. By utilizing this, the removal and refilling of the stack can be scheduled for an optimum time and the number of unnecessary trips to remove the store can be minimised.

DESCRIPTION OF PREFERRED EMBODIMENTS

Preferred embodiments of the invention are herein described with reference to the following drawings.

Figure 1A:
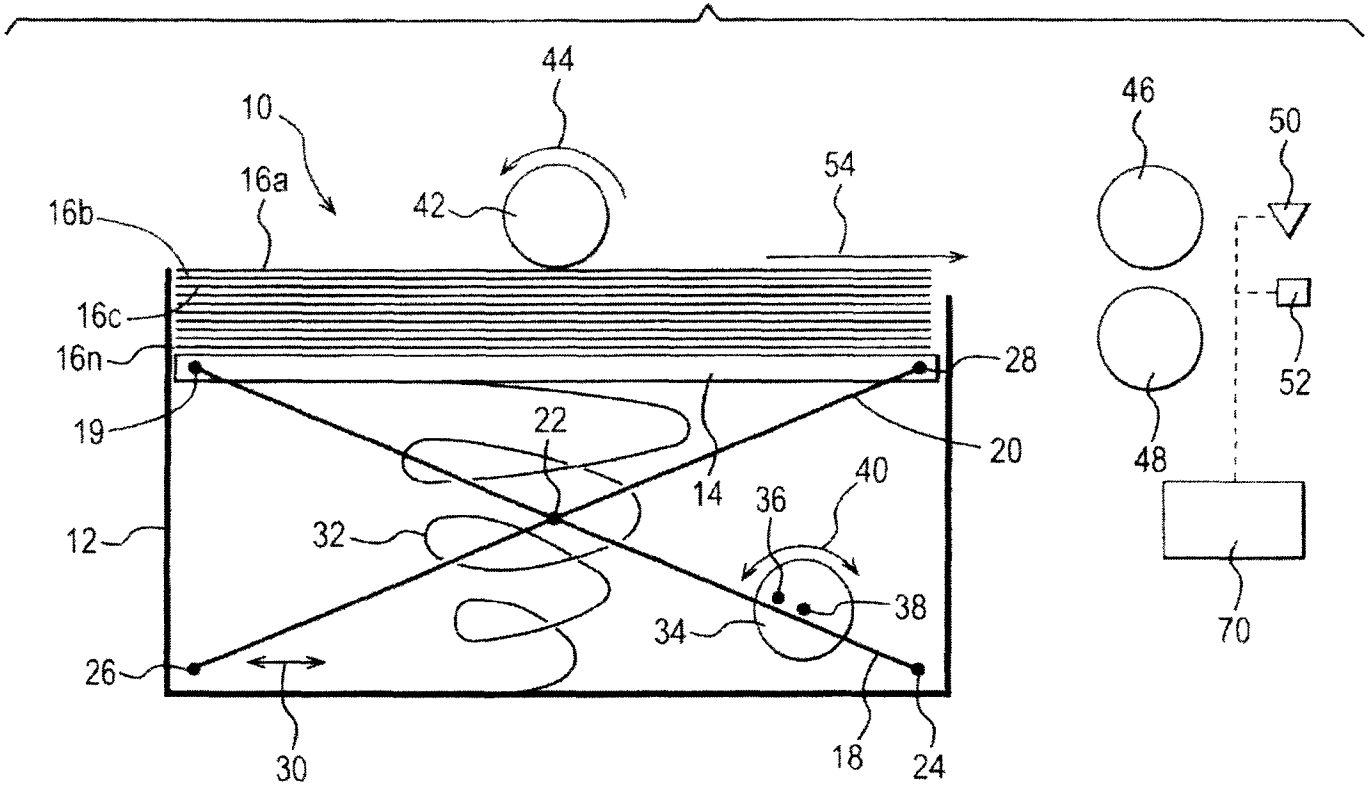
FIGS. 1A to 1E are schematic representations illustrating a mode of operation of a banknote store.

FIG. 1A illustrates a banknote store 10 which includes a housing 12. Contained within housing 12 is a pressure plate 14 which supports a stack of banknotes 16*a*, 16*b*, 16*c*, . . . 16*n*. Pressure plate 14 is supported by two levers 18 and 20 articulated at point 22 to form a scissors arrangement.

Lever 18 is fixed at end 24 relative to the housing 12 whereas movement of end 26 of lever 20 is constrained to allow lateral movement in the directions of arrow 30. The pressure plate 14 is fixed to lever 20 at point 28 and attached to lever 18 at point 19. Movement of lever 18 relative to the pressure plate 14 is permitted at point 19.

As the pressure plate 14 moves up and down, the levers 18 and 20 articulate about point 22, end 26 of lever 20 moves in the direction of arrow 30 and the pressure plate 14 moves relative to the lever 18 to keep the pressure plate 14 level.

A spring 32 biases downwards movement (with reference to the Figures) of the pressure plate 14 and therefore encourages upward movement. A disc 34 is connected to a pin 36 and as the disc 34 rotates, the pin is rotated about axis 38 in the directions of arrow 40. Pin 36 engages with lever 18 to move the pressure plate 14 down by action of the disc 34, upwards movement occurring under action of the spring 32.

The store 10 further includes a banknote dispenser comprising an uptake roller 42 which rotates in direction of arrow 44, an upper transport roller 46 and a lower transport roller 48. A light source 50 and light detector 52 are also provided which are orientated on opposite sides of a transport path along which dispensed banknotes travel.

The uptake roller 42, the upper 46 and lower 48 transport rollers and the disc 34 are driven by motors (not shown) to provide the appropriate rotation of these elements. Furthermore, light source 50 and light detector 52 are connected to a processor 70 (connections not shown) which processes the output of the sensor 52. The motors controlling the rotation of the uptake roller 42, the two transport rollers 46 and 48 and the disc 34 are also connected to and controlled by the processor 70.

To dispense a banknote, uptake roller 42 is rotated in the direction of arrow 44. The spring 32 acts on the pressure plate 14 to bring the uppermost banknote 16*a* into contact with the uptake roller 42. Therefore, rotation of the uptake roller 42 in the direction of arrow 44 will cause movement of the uppermost banknote 16*a* in the direction of arrow 54.

Due to friction between successive banknotes, movement of the uppermost banknote 16*a* under action of the uptake roller 42 may cause movement of the next underlying banknote 16*b* which, in turn, may cause movement of the next underlying banknote 16*c*. It is to be realised that this does not occur with each dispensing operation and the number of banknotes which may be moved together with the topmost banknote 16*a* will vary, depending on the amount of friction between the banknotes. This will depend on the quality of the banknotes and the pressure exerted on the pressure plate 14 by the spring 32. In the operation illustrated, banknotes 16*a*, 16*b* and 16*c* are dispensed together.

The banknotes 16*a*, 16*b* and 16*c* constitute a bundle of banknotes. It is to be realised that fewer or more banknotes may be transported under the action of the uptake roller 42, and the principle herein described is equally applicable to a bundle comprising more or less than three banknotes.

Figure 1B:
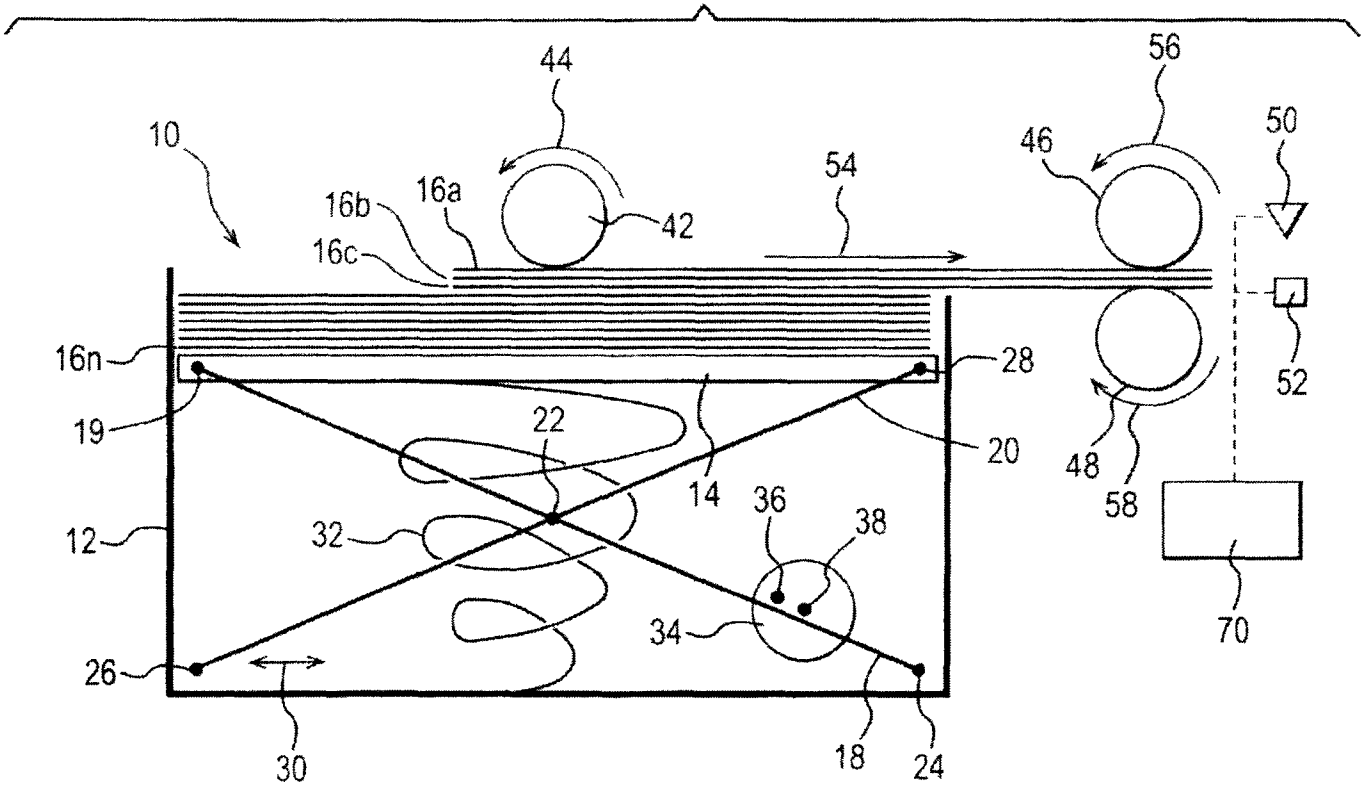

As shown in FIG. 1B, banknotes 16*a*, 16*b* and 16*c* are transported in direction of arrow 54 to engage with transport rollers 46 and 48. Transport rollers 46 and 48 rotate in the directions of respective arrows 56 and 58 to further transport the bundle of banknotes 16*a*, 16*b* and 16*c* in the direction of arrow 54.

Figure 1C:
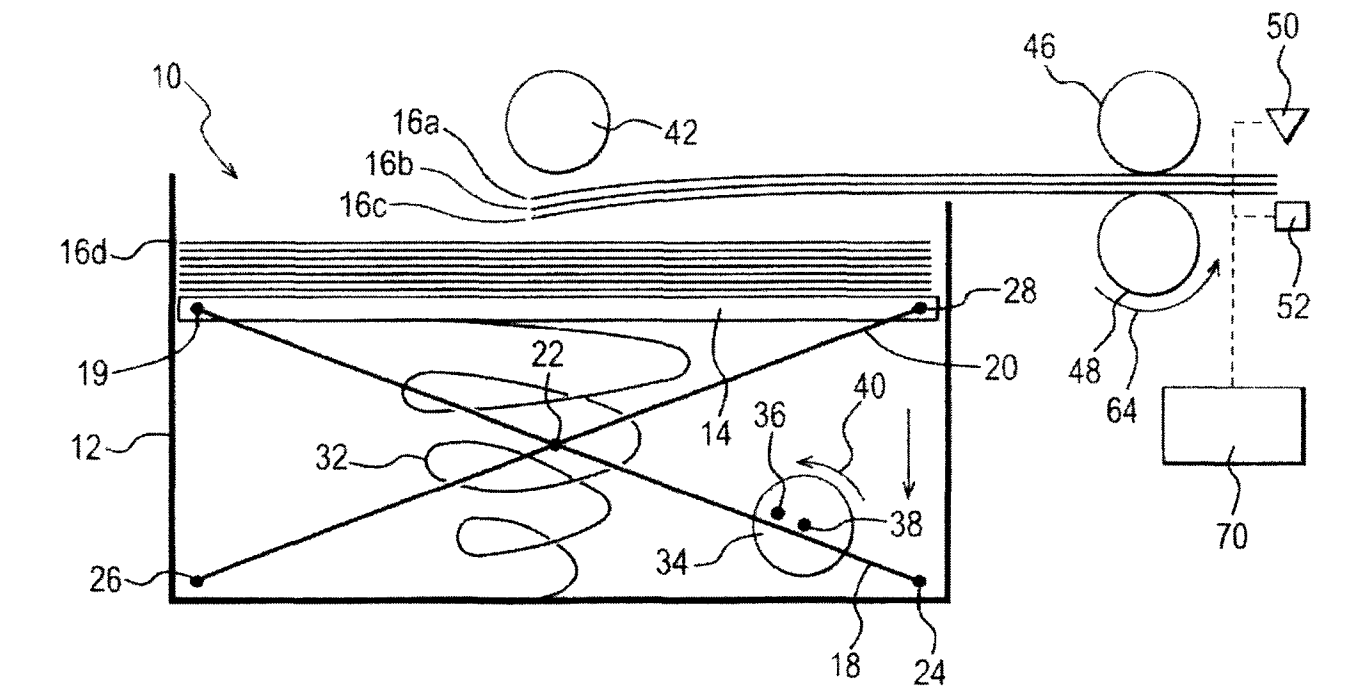

As illustrated in FIG. 1C, when the processor 70 detects that the bundle of value sheets enters the light emitted by light source 50, rotation of the transport rollers 56 and 58 is stopped, as is the rotation of uptake roller 42. When the bundle 16*a*, 16*b* and 16*c* is stationary, processor 70 determines how many banknotes there are in the bundle by measuring the output of sensor 52. The output of sensor 52 will be proportional to the number of banknotes (for which the average transmissivity is known) in the bundle.

If the processor 70 detects that the bundle contains more than a single value sheet, disc 34 is rotated in direction of arrow 60 causing pin 36 to engage with lever 18, moving the pressure plate 14 down in direction of arrow 62. As illustrated in FIG. 1C, the lowering of the pressure plate 14 reduces the contact area between banknote 16*c* and the topmost banknote 16*d* remaining in the stack, because the bundle is supported by the transport rollers 46 and 48.

Once the pressure plate 14 has been lowered, lower transport roller 48 is rotated in direction of arrow 64 whereas upper transport roller 46 remains stationery.

Figure 1D:
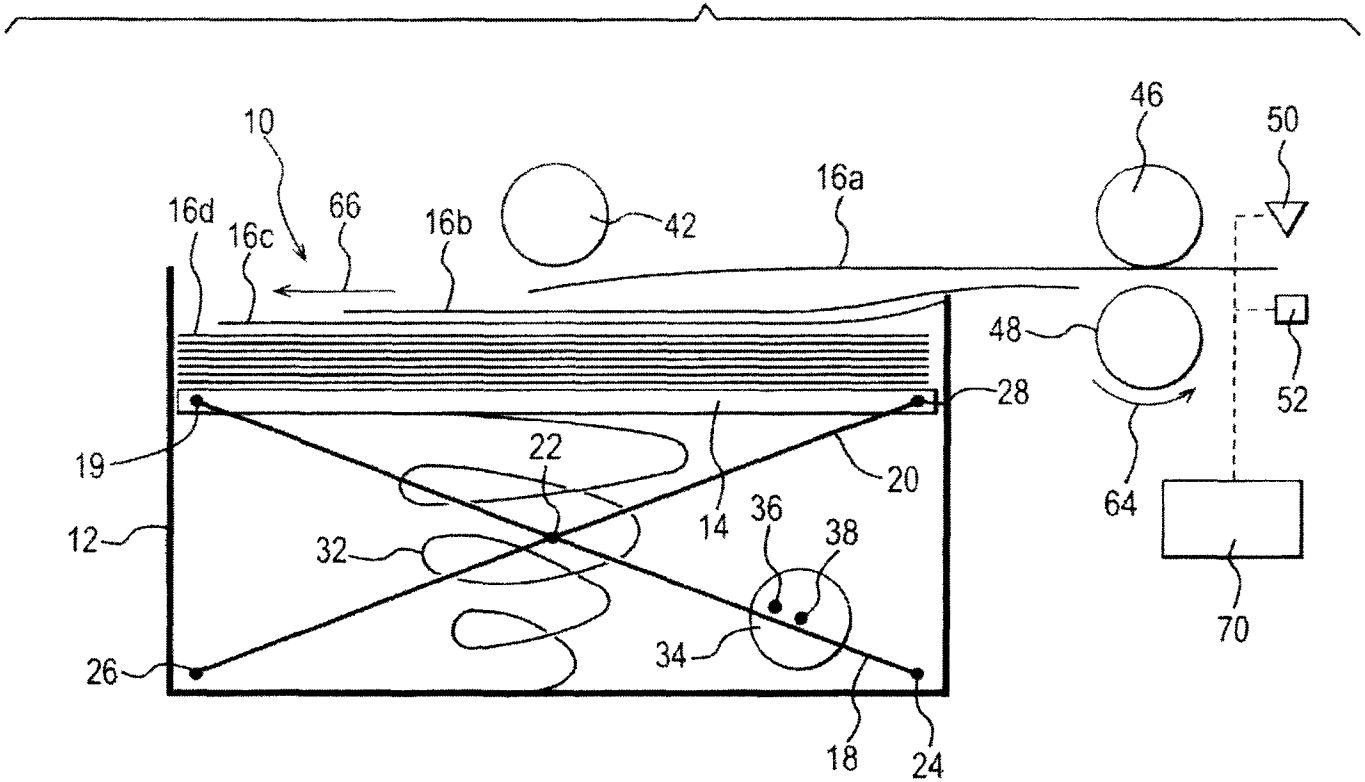

As illustrated in FIG. 1D, rotation of lower transport roller 48 in direction of arrow 58 drives the underlying banknotes 16*b* and 16*c* of the bundle back towards the stack in direction of arrow 66. Engagement between the uppermost banknote 16*a* with upper transport roller 46 while this roller stays stationary ensures that the uppermost banknote 16*a* remains in place.

Upper transport roller 46 has a higher coefficient of friction than the lower transport roller 48. Therefore, once the underlying banknotes 16*b* and 16*c* have been returned to the stack, engagement between the lower transport roller 48 and the uppermost banknote 16*a* does not move the uppermost banknote 16*a*.

In an alternative embodiment, to ensure that the banknote 16*a* does not move, the upper transport roller 46 may be rotated in the direction of arrow 56 illustrated in FIG. 1B.

In a further embodiment, banknotes 16*a*, 16*b* and 16*c* are separated from one another by rotation of upper 46 and lower 48 transport rollers in the respective directions of arrows 56 and 58 but at different rates, upper transport roller 46 being rotated faster than lower transport roller 48. In this case, banknotes 16*b* and 16*c* will be returned to the stack once banknote 16*a* has been separated from the bundle by subsequently reversing the direction of rotation of upper 46 and lower 48 transport rollers.

Figure 1E:
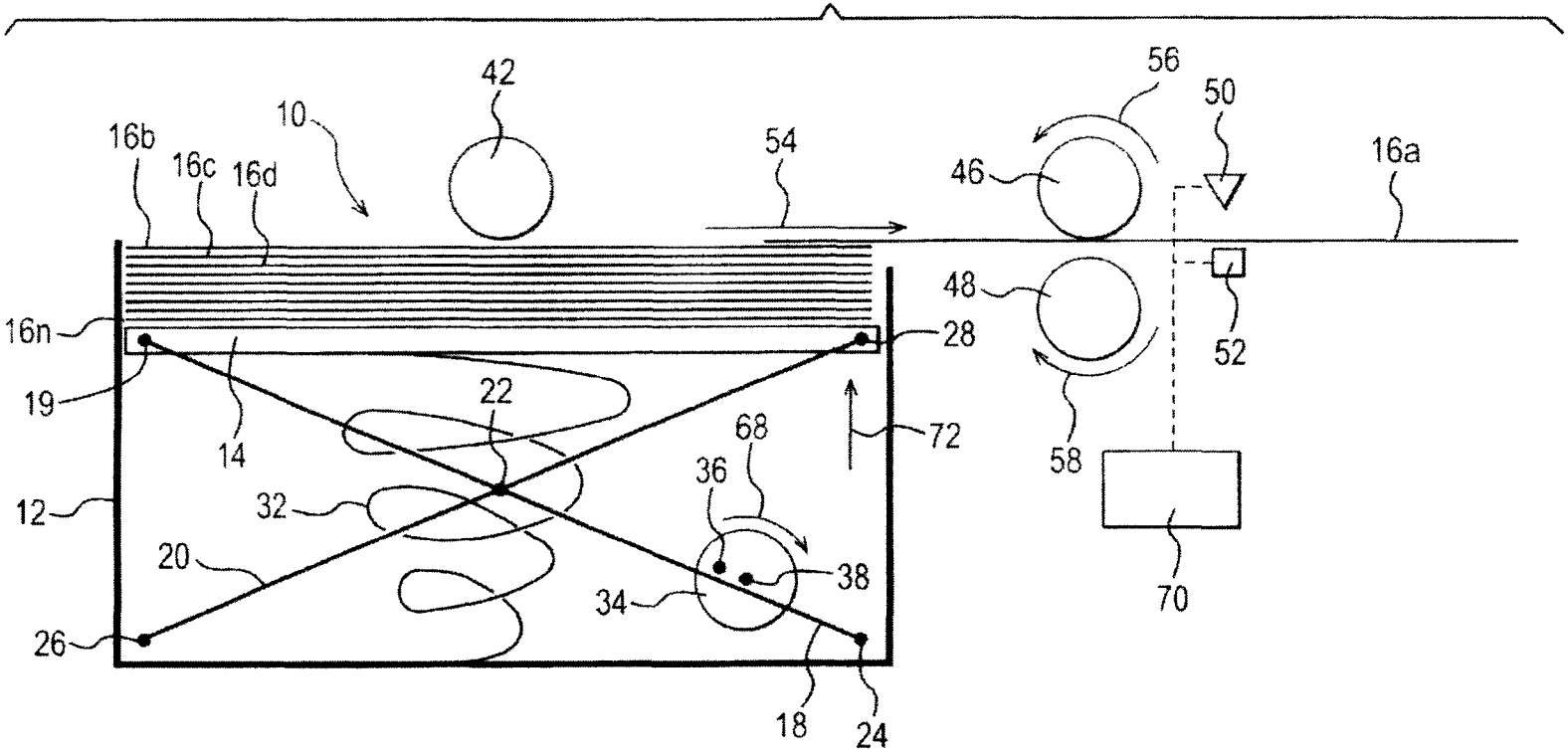

Once the processor 70 detects that all but the topmost banknote 16*a* of the bundle have been returned to the stack, the disc 34 is rotated in the direction of arrow 68 (FIG. 1E) so that the pressure plate 14 moves upwards in direction of arrow 72 under the action of spring 32 and the topmost banknote 16*b* of the stack is brought into contact with the uptake roller 42.

Upper 46 and lower 48 transport rollers are then rotated in the directions of respective arrows 56 and 58 and banknote 16*a* is further transported in direction of arrow 54.

The stack is then in a state to dispense the next topmost banknote 16*b* on the stack.

Figure 2:
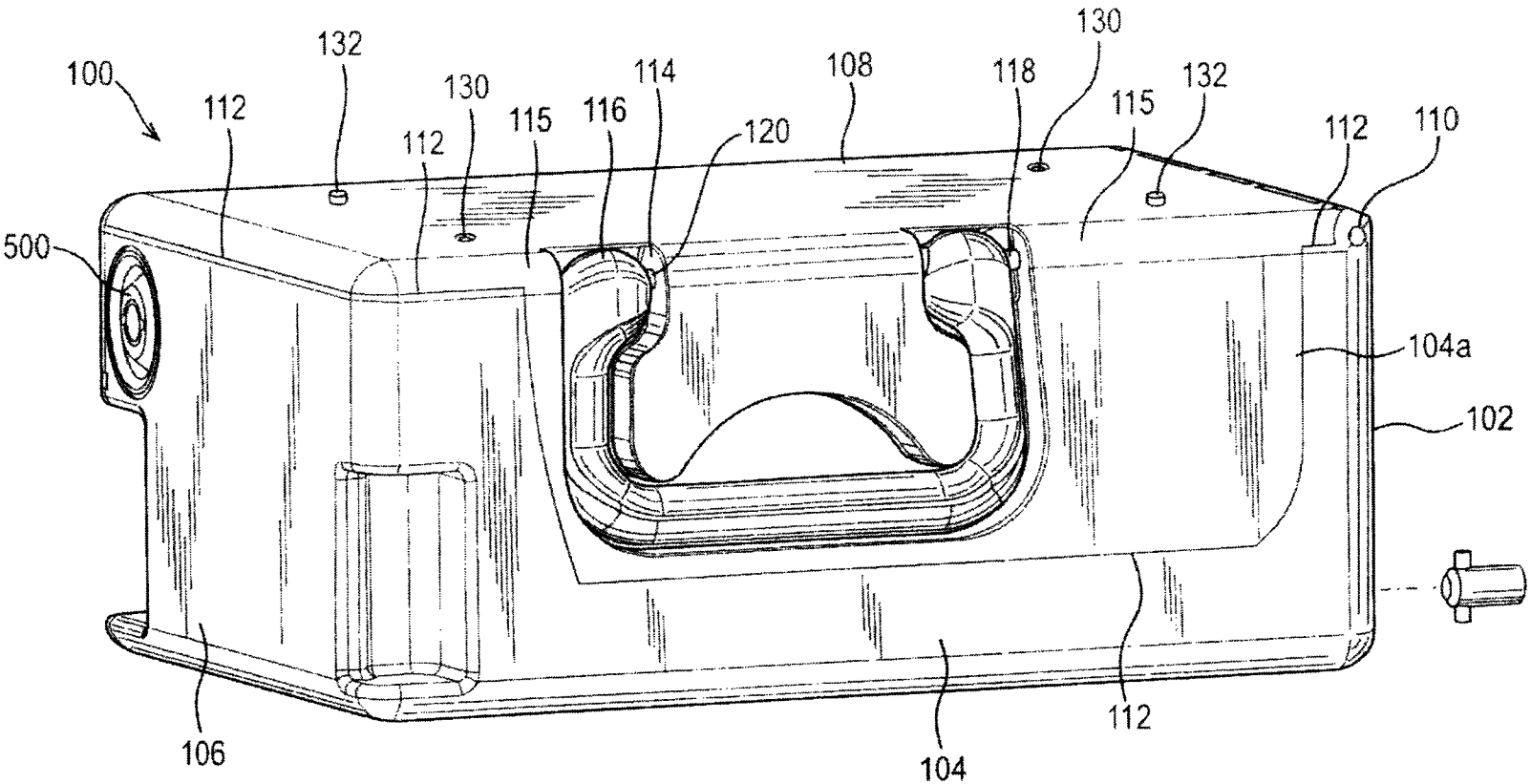
FIG. 2 is an isometric view of a banknote store according to a preferred embodiment of the invention.

FIG. 2 illustrates a banknote store 100 according to a preferred embodiment of the invention which includes a housing 102 having a front side wall 104, a left side wall 106, and a lid 108. Although not visible in this Figure, the housing also includes right and back side walls and a bottom wall. Portion 104*a* of side wall 104 is integrally formed with the lid 108.

The lid 108 pivots relative to the right side wall about a shaft 110 and when it does so, the lid will separate from the side walls along line 112. Because portion 104*a* of side wall 104 is formed as part of lid 108, opening of the lid will provide a void in side wall 104 which provides a user or maintainer access to the innards of the store 100.

A recess 114 is formed in the lid 108 and a handle 116 is located in the recess 114. The handle 116 pivots about axes 118 and 120 which form a hinge for the handle 116. As illustrated in FIG. 2, the axes 118 and 120 lie on an edge 115 between side wall 114 and lid 108.

Lid 108 includes two recesses 130 and two complementary projections 132. Recesses 130 and projections 132 are formed and symmetrically arranged on the lid 108 so that when two stores such as the store 100 are arranged with respective lids abutting, the projection of one store will engage with the corresponding recess of the other store. This prevents movement of the two stores relative to one another when, for example, the stores are being transported.

Furthermore, as previously stated, handle 116 is attached to the housing 102 by axes 118 and 120 which lie on an edge 115 of the housing 102. Therefore, two such stores can be arranged so that their respective lids abut and their respective handles will, when extended, be arranged so that they extend next to one another. A user may therefore conveniently carry two such stores by grasping both handles together in one hand.

Figures 3, 4:
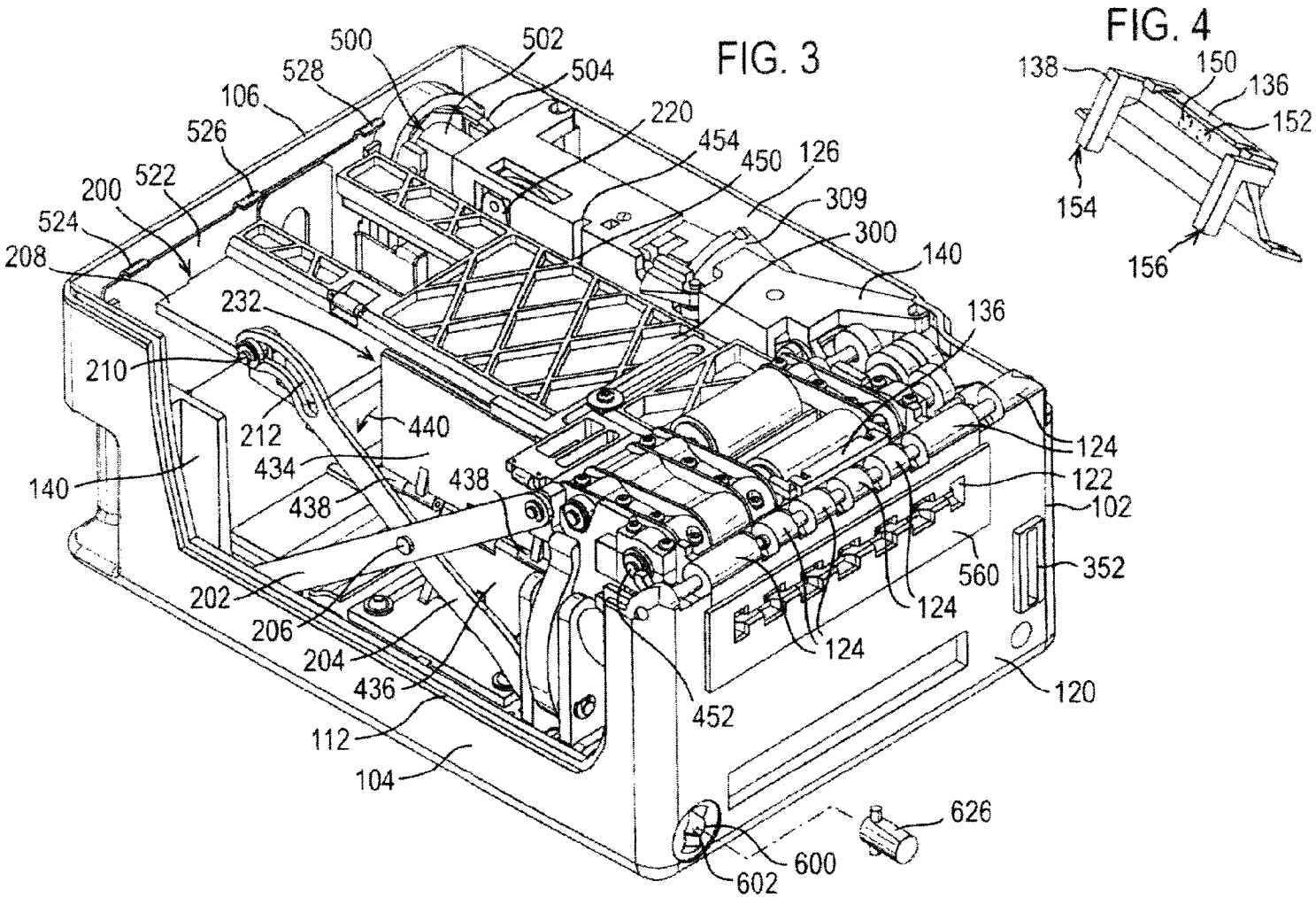
FIG. 3 is an isometric view of a detail of the banknote store of FIG. 2.
FIG. 4 illustrates a light guide and support for use with the banknote store of FIG. 2.

FIG. 3 illustrates the banknote store 100 with the lid 108 removed. Right side wall 120 is formed to define an aperture 122 through which banknotes are dispensed during operation of the banknote store 100.

Right side wall 120 includes formations 124 through which shaft 110 runs, forming a hinge between the right side wall 120 and the lid 108 (FIG. 2).

Contained within the housing 102, the banknote store 100 includes an internal chassis 140, a stack support assembly 200 and a plate 300.

Figure 5:
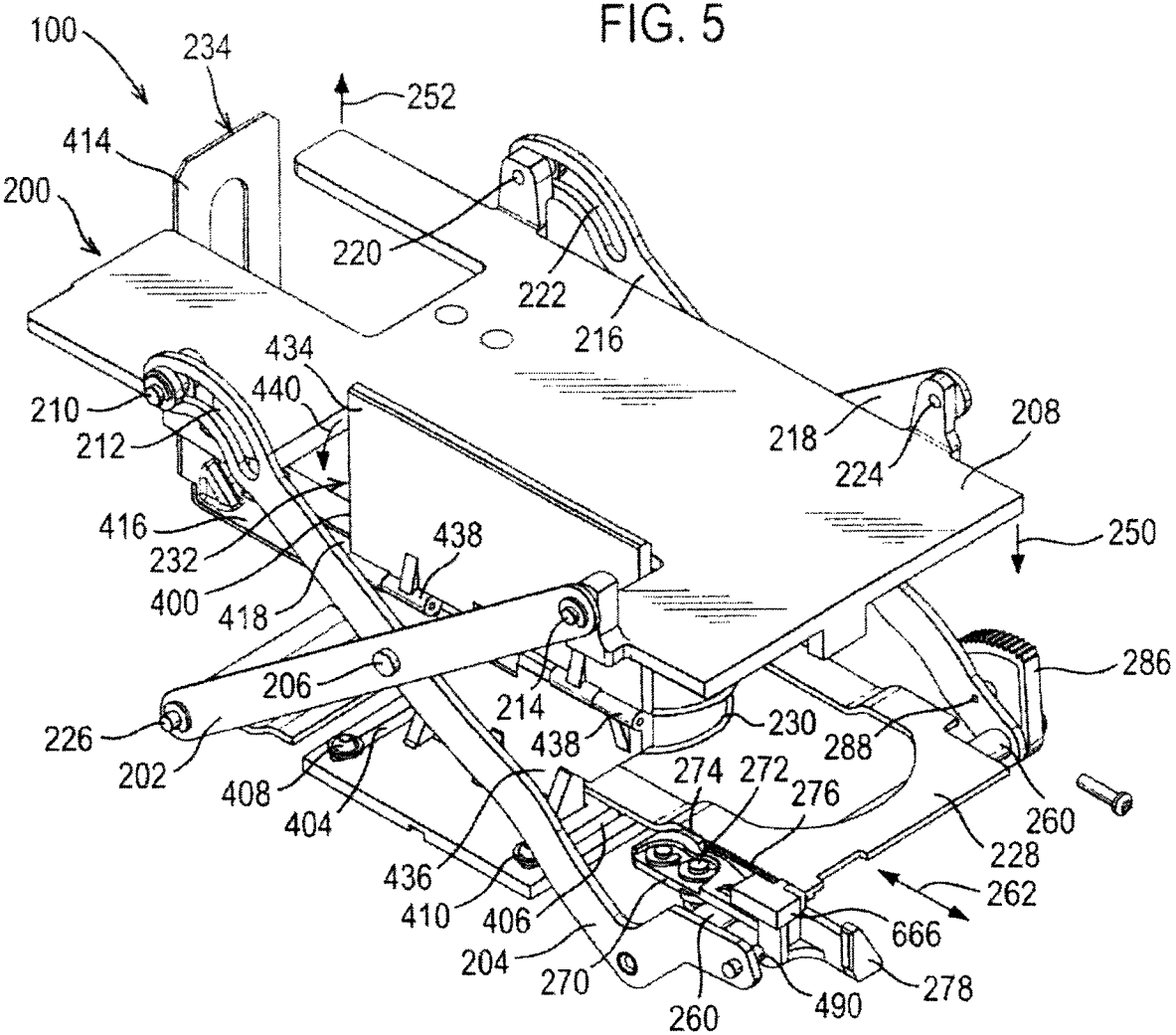
FIG. 5 is an isometric view of a detail of the banknote store of FIG. 2.

The stack support assembly 200 is further illustrated in FIG. 5. The assembly 200 includes a first front lever 202 and a second front lever 204 joined to one another by pin 206 so that they swivel relative to one another about an axis formed by pin 206.

The assembly 200 further includes a pressure plate 208 attached to second front lever 204 by pin 210. Second front lever 204 has a recess 212 formed therein so that movement of the pressure plate 208 relative to the second front lever 204 is constrained by the movement of pin 210 in the recess 212. Pressure plate 208 is connected to the first front lever 202 by pin 214.

Figure 6:
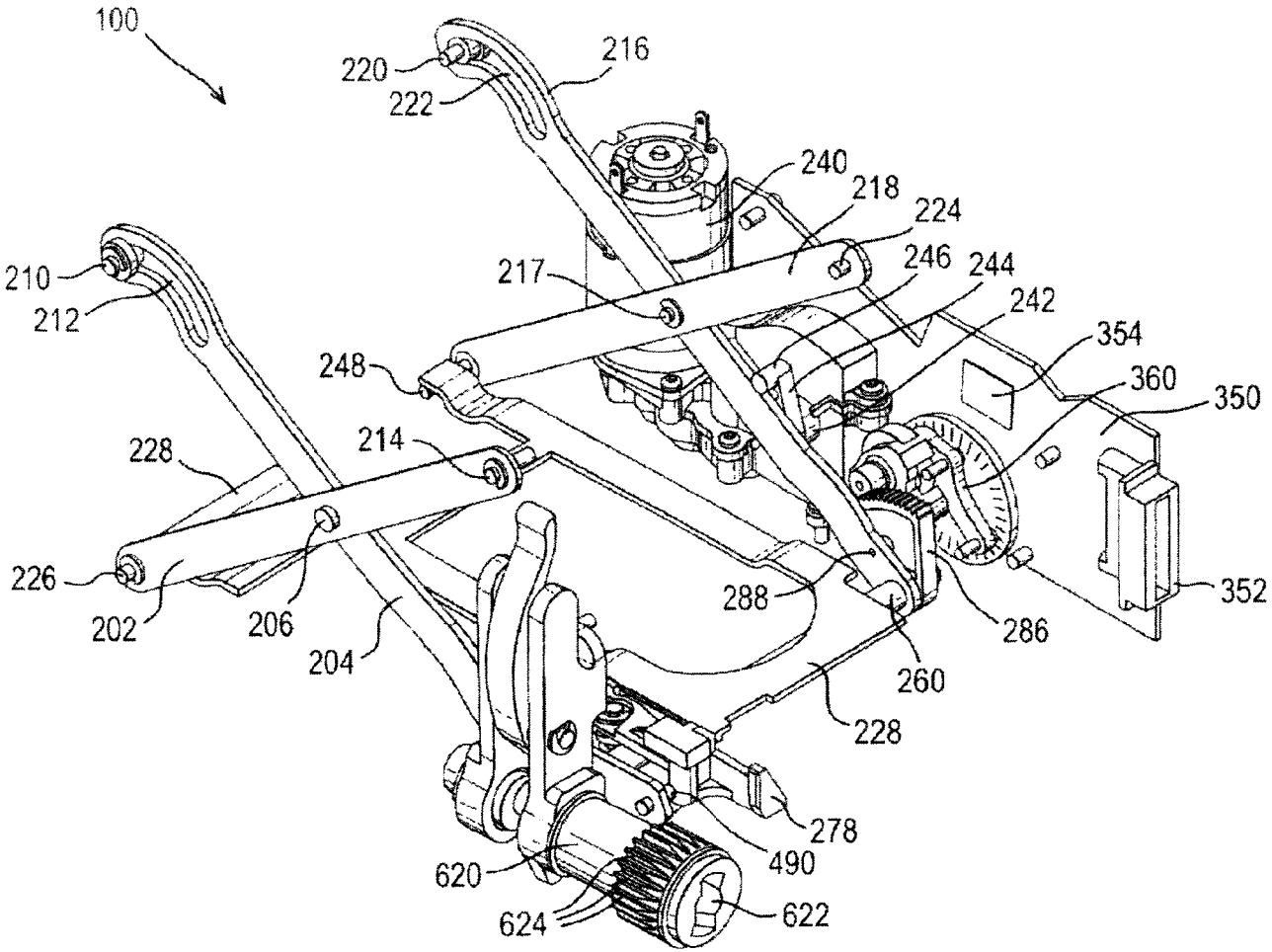
FIG. 6 is an isometric view of a detail of the banknote store of FIG. 2.

A first back lever 218 is connected to a second back lever 216 by pin 217 (see FIG. 6). First 218 and second 216 back levers connect to the pressure plate 208 in a similar manner with pin 220 located in recess 222 of lever 216 and pin 224 connecting the first back lever 218 and the pressure plate 208. The second front lever 204 is connected to the second back lever 216 by means of rod 260 which is immovably connected to the internal chassis 140. Levers 204 and 216 are pivotally mounted to this rod 260.

A helical spring 230 (FIG. 5) acts between the pressure plate and the bottom wall of the housing 102 of the banknote store 100 (FIG. 2).

The stack support assembly 200 further includes two lateral guides 232 and 234 (described with reference to FIG. 7, below).

Referring to FIG. 6, a motor 240 is located between the back wall 126 of housing 102 and the internal chassis 140. The motor 240 is connected by a series of cogs (not shown) to disc 242 which in turn is connected to arm 244. The arm 244 is formed with a pin 246 which engages with the second back lever 216.

The first front lever 202 is connected to a reciprocating plate 228 by rod 226 and first back lever 218 is connected to the plate 228 by rod 248.

The motor 240 rotates the disc 242, causing the pin 246 to move the second back lever 216. Through the aforementioned connections between the second back lever 216, the pressure plate 208, the first back lever 218 and the first 202 and second 204 front levers, and because the rod 260 connecting the levers 204 and 216 is immobile relative to the internal chassis 140, the pressure plate is moved downwards in the direction of arrow 250 (FIG. 5) relative to the internal chassis 140 when pin 246 is rotated in the appropriate direction. The action of the helical spring 230 on the pressure plate 208 moves the pressure plate 208 upwards in the direction of arrow 252 (FIG. 5) relative to the internal chassis 140.

In use of the store 100, the pressure plate 208 supports a plurality of banknotes arranged in a stack on an upper surface of the plate 208. As the plate is moved up and down so too is the stack of banknotes.

The reciprocating plate 228 moves back and forth in the directions of arrow 262 as the pressure plate 208 moves up and down. An arm 270 is connected to the internal chassis 140 and pivots about an axis formed by pin 272. Arm 270 includes an abutment 274 which has a serrated surface. A complimentary serrated surface 276 is formed on the reciprocating plate 228.

By pivoting the arm 270, the serrated surface of abutment 274 can be brought into engagement with the serrated surface 276 of the reciprocating plate 228, preventing relative movement between the arm 270 and the reciprocating plate 228. This prevents movement of the pressure plate 208 thereby anchoring the plate 208 in any position.

This is useful when the store 100 is transported as it prevents unnecessary movement of the pressure plate 208 which could disturb the stack of banknotes, causing misalignments and jams of the banknotes when dispensing operations are attempted.

Figure 7:
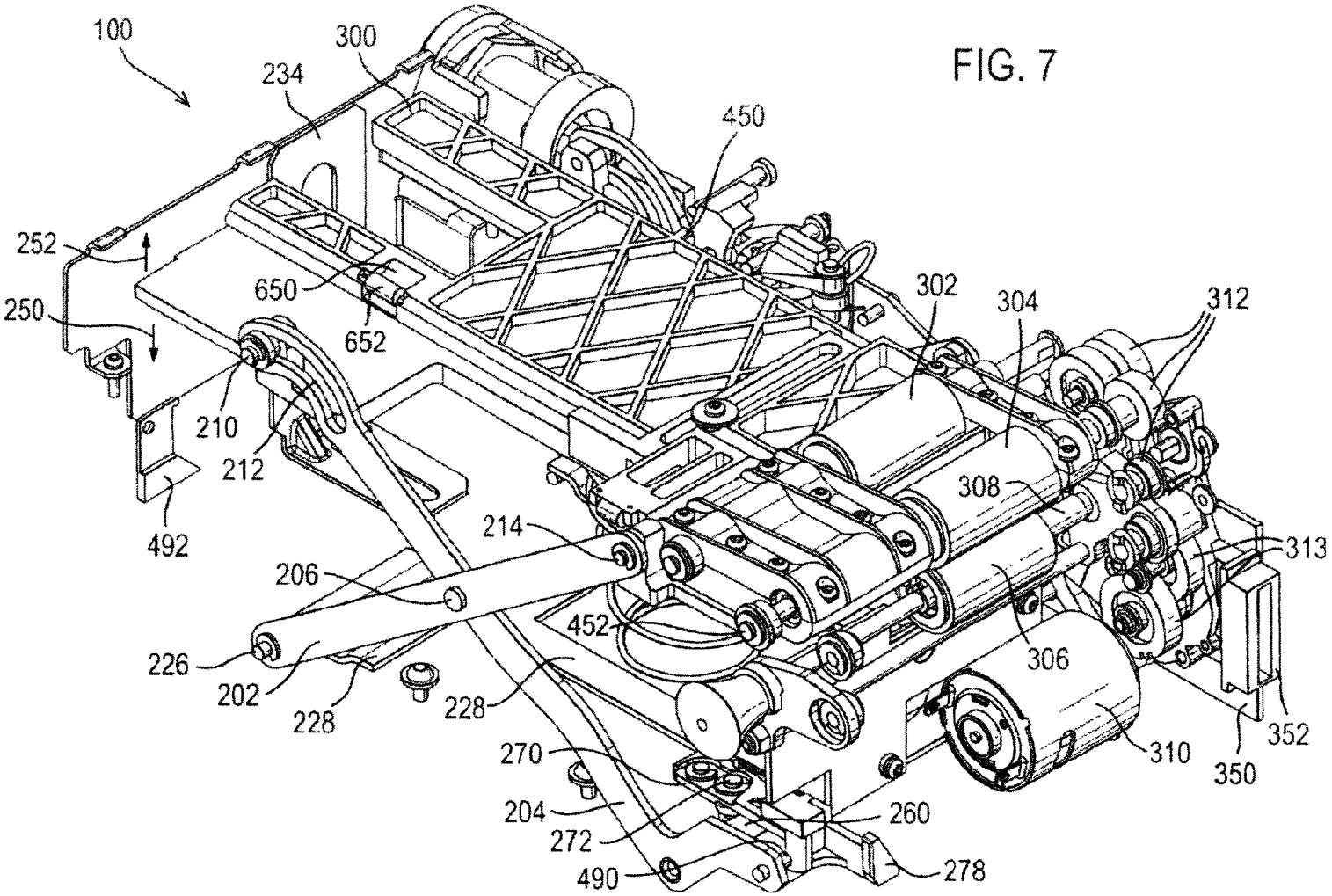
FIG. 7 is an isometric view of a detail of the banknote store of FIG. 2.

Referring to FIG. 7, an uptake roller 302 and an upper transport roller 304 are rotatably attached to plate 300. A lower transport roller 306 is rotatably attached to the plate 300 by axle 308. A motor 309 (illustrated in FIG. 3) drives the uptake roller 302 and the upper 304 and lower 306 transport rollers via a worm gear (not shown) and cog gears 312, in a manner known in the art, so that uptake roller 302 and the upper 304 and lower 306 transport rollers interact with banknotes to dispense the banknotes from the store 100. Motor 310 drivers roller 306 through a chain of gears 313 in a direction which returns banknotes to the stack, as required. Therefore, the uptake roller 302 and the upper 304 and lower 306 transport rollers interact with banknotes from the stack supported by pressure plate 208 in the manner described above when referring to uptake roller 42 and upper 46 and lower 48 transport rollers illustrated in FIGS. 1A to 1D.

Referring back to FIG. 3, the banknote store 100 includes a support 136 connected to internal chassis 140 and supporting a light guide 138, shown in greater detail in FIG. 4. Two LEDs 150 and 152, shown in dotted outline, are housed in the light guide 138. When the LEDs 150 and 152 are activated, the light guide 138 gathers the light emitted and directs it downwards, towards a banknote transport path extending between a topmost banknote stored on the stack, supported by pressure plate 208 and the aperture 122. The light is emitted through apertures 154 and 156 of light guide 138.

Figure 8:
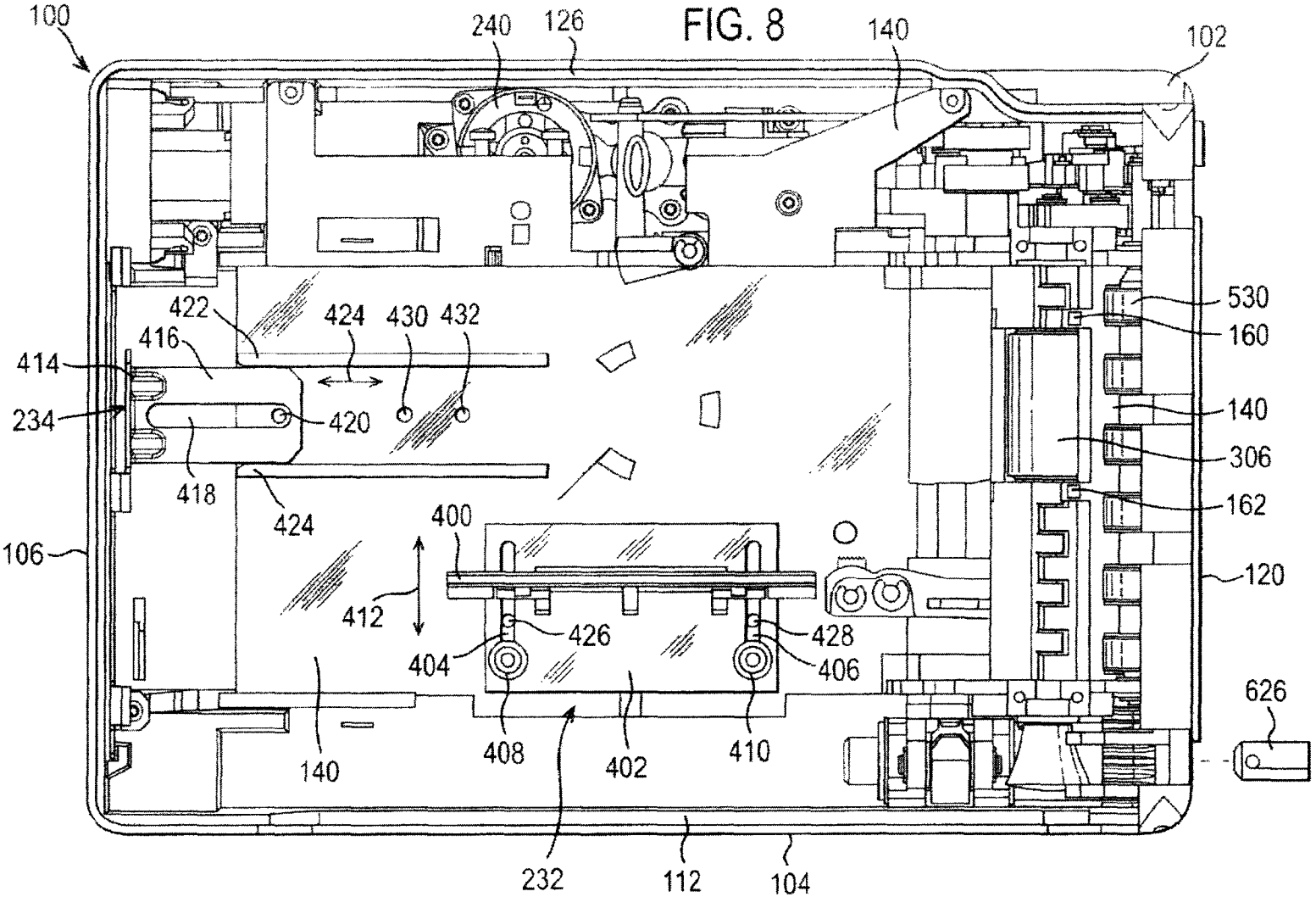
FIG. 8 is a plan view of a detail of the banknote store of FIG. 2.

As illustrated in FIG. 8, internal chassis 140 includes sensors 160 and 162 located opposite respective apertures 154 and 156 of the light guide 138. Therefore light emitted by the LEDs 150 and 152 is sensed by the sensors 160 and 162. As the light guide 138 and the sensors 160 and 162 are located on opposite sides of the banknote transport path, when one or more banknotes are appropriately positioned, the sensors 160 and 162 will sense the light transmitted through the banknotes.

Referring back to FIG. 7, the banknote store 100 includes a circuit board 350 connected to the motor 310, the belts, pulleys and clutches system 312 and the motor 240 (FIG. 6). The circuit board 350 includes a connector 352 and is provided with a processor 354 having a memory.

The processor 354 controls the motor 310, the belts, pulleys and clutches system 312, the motor 240 and the LEDs 150 and 152, and monitors the sensors 160 and 162 to operate these elements to dispense banknotes stored in the store 100 in the manner described above with reference to the banknote store 10 of FIGS. 1A to 1E.

FIG. 8 is a top view of the banknote store 100 illustrating the orientation of the lateral guides 232 and 234 with respect to the left side wall 106 and the front side wall 104 of the housing 102.

Lateral guide 232 includes a vertical portion 400 and a horizontal portion 402. Two elongated recesses 404 and 406 are formed in the horizontal portion 402. Two screws 408 and 410 are located in respective recesses 404 and 406 and act to attach the guide 232 to the floor of the internal chassis 140 (in which complimentary holes (not shown) are formed).

The screws 408 and 410 are manually operable so that they can be tightened and loosened by a user. Once the screws 408 and 410 are loosened, the guide may be moved in the directions of arrow 412 and the screws tightened when the side 232 is in the desired position.

Lateral guide 234 includes a vertical portion 414 and a horizontal portion 416. Horizontal portion 416 is formed with a recess 418 and a screw (not shown) attaches the horizontal portion 416 to the floor of the internal chassis 140 through a hole 420 formed therein. A user can move the lateral guide 234 in the directions of arrow 424 by loosening the screw. The floor of the chassis 140 is formed with elongated abutments 422 and 424 to constrain movement of the horizontal portion 416 of the guide 234. When the guide 234 is in the desired location, the screw is tightened again.

By moving the lateral guides in this manner, the banknote store 100 can accommodate stacks of banknotes of different widths and lengths and lateral movement of banknotes of the stack is prevented by the guides.

The floor of the chassis 140 is further formed with holes 426 and 428 to accommodate respective screws 408 and 406. Similarly, the floor of the chassis 140 is formed with holes 430 and 432 to accommodate the screw which engages with hole 420. These additional holes 426, 428, 430 and 432 are spaced so that the guides can be quickly moved to accommodate banknotes of predetermined standard sizes by insertion of the respective screws in the desired hole and abutting the respective recesses of the horizontal portion of the guide to be moved against the screw.

As illustrated in FIGS. 3 and 5, vertical portion 400 of lateral guide 232 is formed from upper portion 434 and a lower portion 436 joined to one another by a hinge 438 which allows movement of the upper portion 434 relative to the lower portion 436 in the direction of arrow 440. The hinge 438 includes a spring (not shown) to move the upper portion 434 in the opposite direction to arrow 440.

Movement of the upper portion 434 relative to the lower portion 436 of the vertical portion 400 of lateral guide 232 provides a user with access to a stack of banknotes supported by the pressure plate 208, without having to move the lateral guide 232.

With reference to FIGS. 3 and 7, plate 300 includes a protrusion 450. Plate 300 is hinged with respect to the internal chassis 140 by rod 452. As the plate 300 pivots about rod 452, protrusion 450 reciprocates in a void 454 formed in internal chassis 140.

Figure 9:
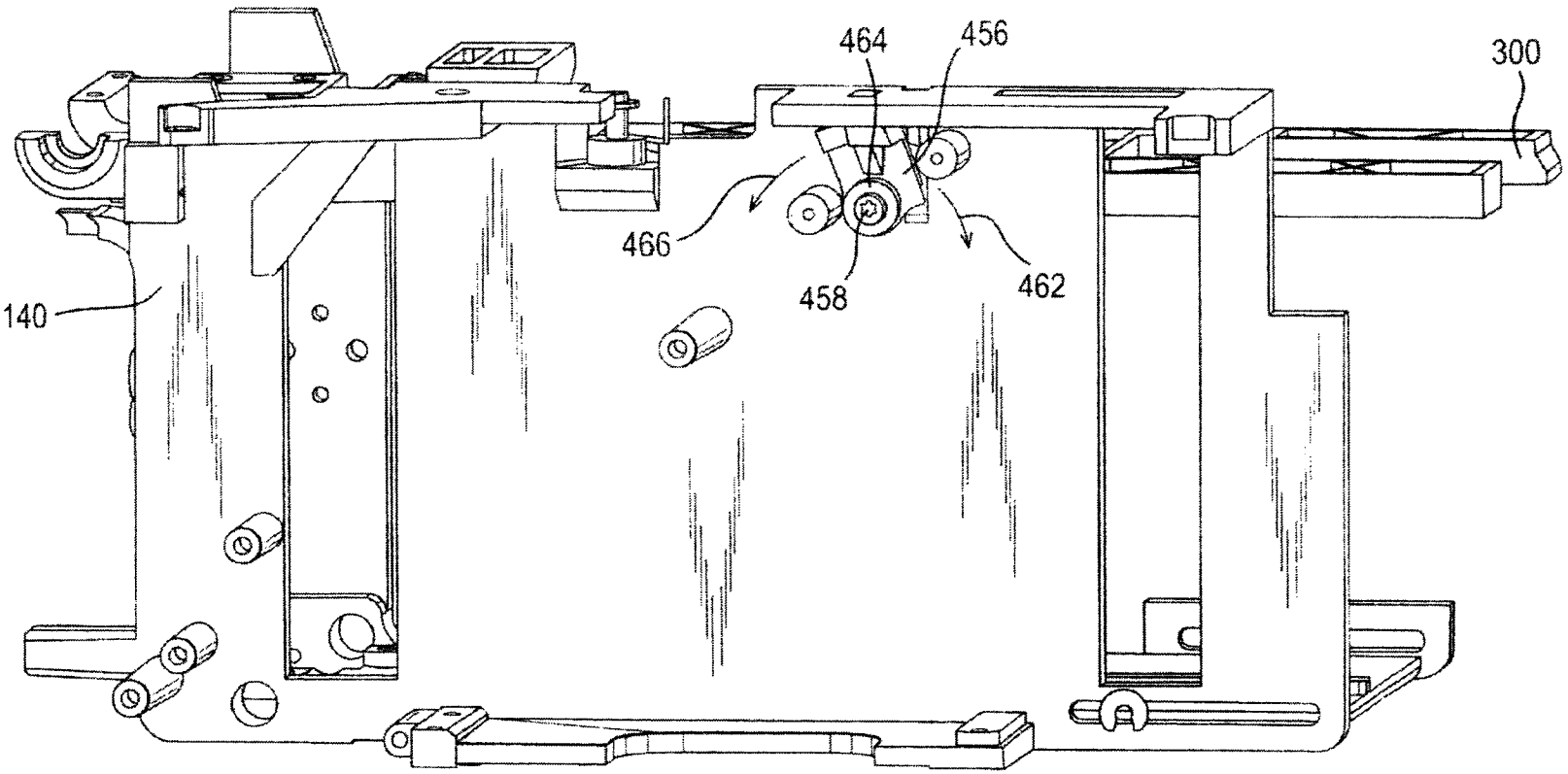
FIG. 9 is an offset rear view of a detail of the banknote store of FIG. 2.

As illustrated in FIG. 9, an indicator 456 is pivotally attached to the internal chassis 140 about axis 458 on the opposite side of the chassis 140 to the plate 300.

Figure 10:
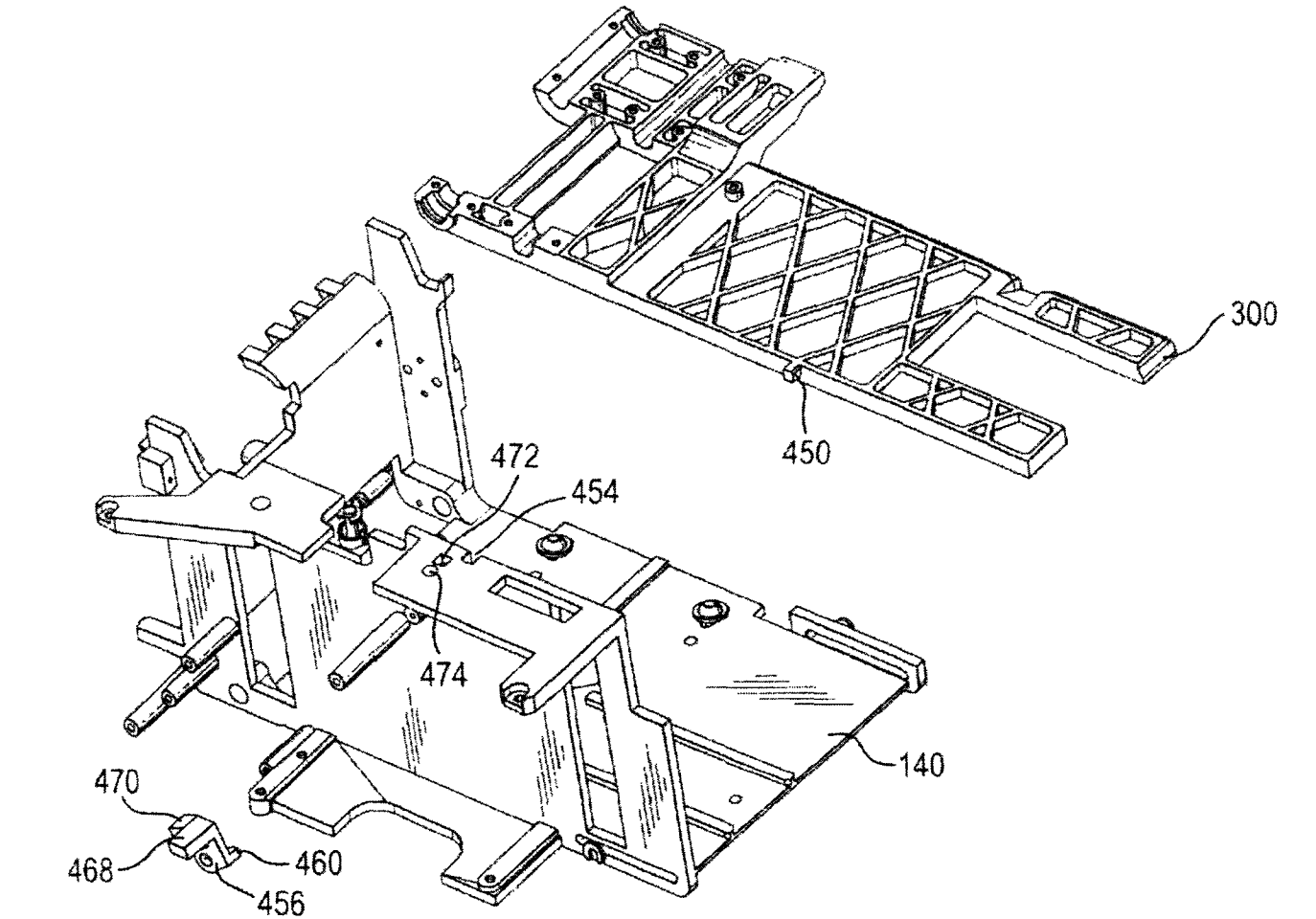
FIG. 10 is an exploded view of the detail illustrated in FIG. 9.

FIG. 10 illustrates the plate 300, the internal chassis 140 and the indicator 456 in exploded view. As protrusion 450 of plate 300 reciprocates in void 454, the protrusion 450 engages with extension 460 of indicator 456, causing the indicator 456 to pivot about axis 458 in direction of arrow 462 (FIG. 9). Indicator 456 includes a spring 464 which moves the indicator 456 in the opposite direction, in the direction of arrow 466 when protrusion 450 is lifted as plate 300 pivots upwards. Thereby indicator moves between a rest position (in the direction of arrow 466) and an operational position (in the direction of arrow 462).

Referring back to FIG. 10, indicator 456 has a first indicator surface 468 and a second indicator surface 470 said surfaces 468 and 470 forming a flag. Internal chassis 140 is formed with a void 472 through which the first indicator surface 468 is visible when the indicator is in its rest position and second indicator surface 470 is visible when the indicator 456 is in its operational position.

Figure 11:
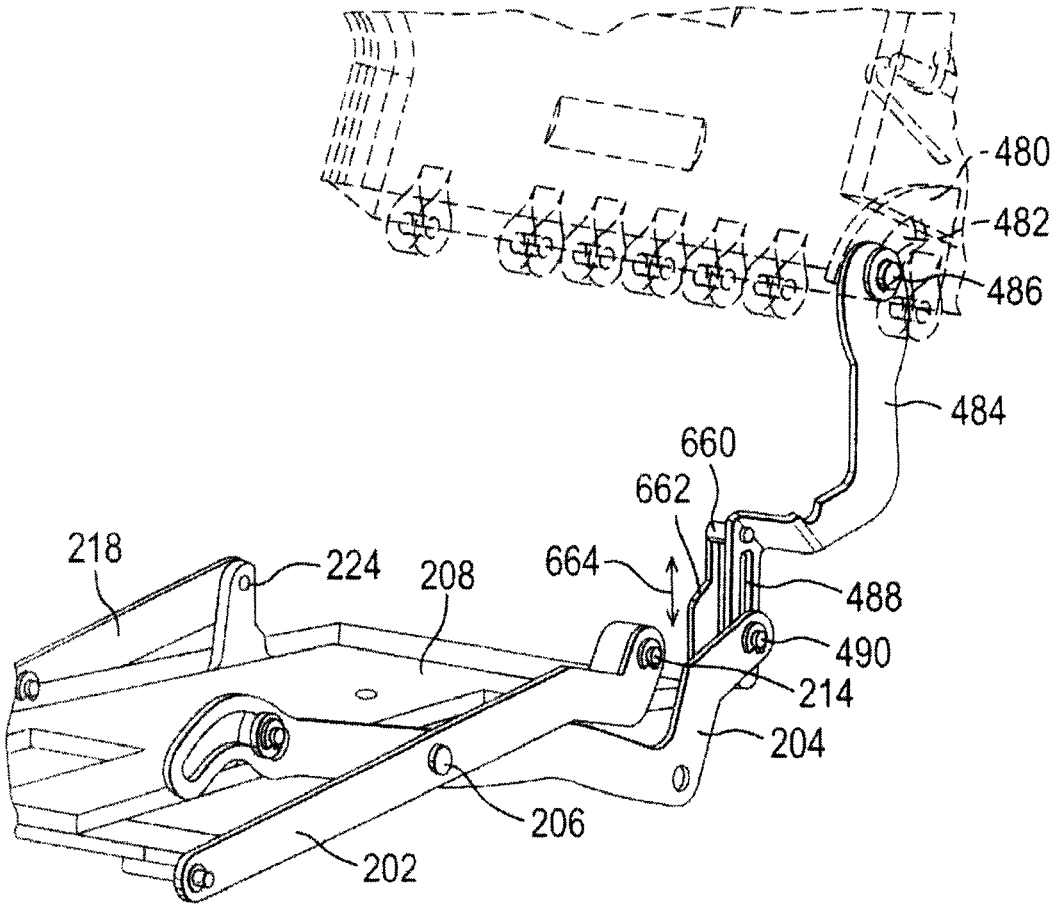
FIG. 11 is an isometric view of a detail of the banknote store of FIG. 2.

FIG. 11 illustrates a portion of certain parts of the banknote store 100. Lid 108 (shown in dotted outline) includes an actuator 480 in which a void 482 is formed. A lever 484 connects the lid 108 to the second front lever 204 of the stack support assembly 200. A pin 486 at the upper end of the lever 484 reciprocates in void 482 of the actuator 480.

The lever 484 includes a void 488 and pin 490 of second front lever 204 reciprocates in the void 488. As the lid 108 is opened by pivoting about shaft 110 (FIG. 2), actuator 480 engages with pin 486 to move lever 484. Movement of lever 484 will cause pin 490 to engage with void 488 to move the second front lever 204. As previously described, movement of lever 204 will move the pressure plate 208.

Therefore, opening of the lid 108 will move the pressure plate 208 downwards in the direction of arrow 250 (FIGS. 5 and 7) until the pressure plate engages with stop 492 attached to side wall 106. It will be realised that once the lid is fully opened, the pressure plate 208 will be placed in a predetermined position determined by the placement of stop 492 which, in the embodiment illustrated, provides a leeway of 51 mm for the pressure plate 208 to move downwards during a dispensing operation. Closure of the lid will cause the stop to move, thereby allowing upwards movement of the pressure plate 208 again (this mechanism is not illustrated in the Figures).

When a user replenishes the stack of banknotes in the store 100, the lid 108 is opened, moving the pressure plate 208 to the predetermined position. The plate 300 is pivoted about rod 452 and banknotes are placed on the pressure plate 208 constrained by lateral guides 232 and 234. The plate 300 is then pivoted back to the position shown in the Figures.

If there are too many banknotes in the stack, the plate 300 will not pivot back sufficiently for the protrusion 450 to engage with extension 460 of the indicator 456. In this instance the first indicator surface 468 will remain aligned with the void 472. In the embodiment shown, the first indicator surface 468 is coloured red to indicate to a user that the stack contains too many banknotes.

If the height of the banknote stack is sufficiently short, the plate 300 can be fully pivoted back into position, so that protrusion 450 engages with extension 460 of indicator 456 moving the indicator 456 in the direction of arrow 462 brining the second indicator surface 470 into alignment with the void 472. The second indicator surface 470 is coloured green to indicate to a user that the store can be secured and used.

Figure 12:
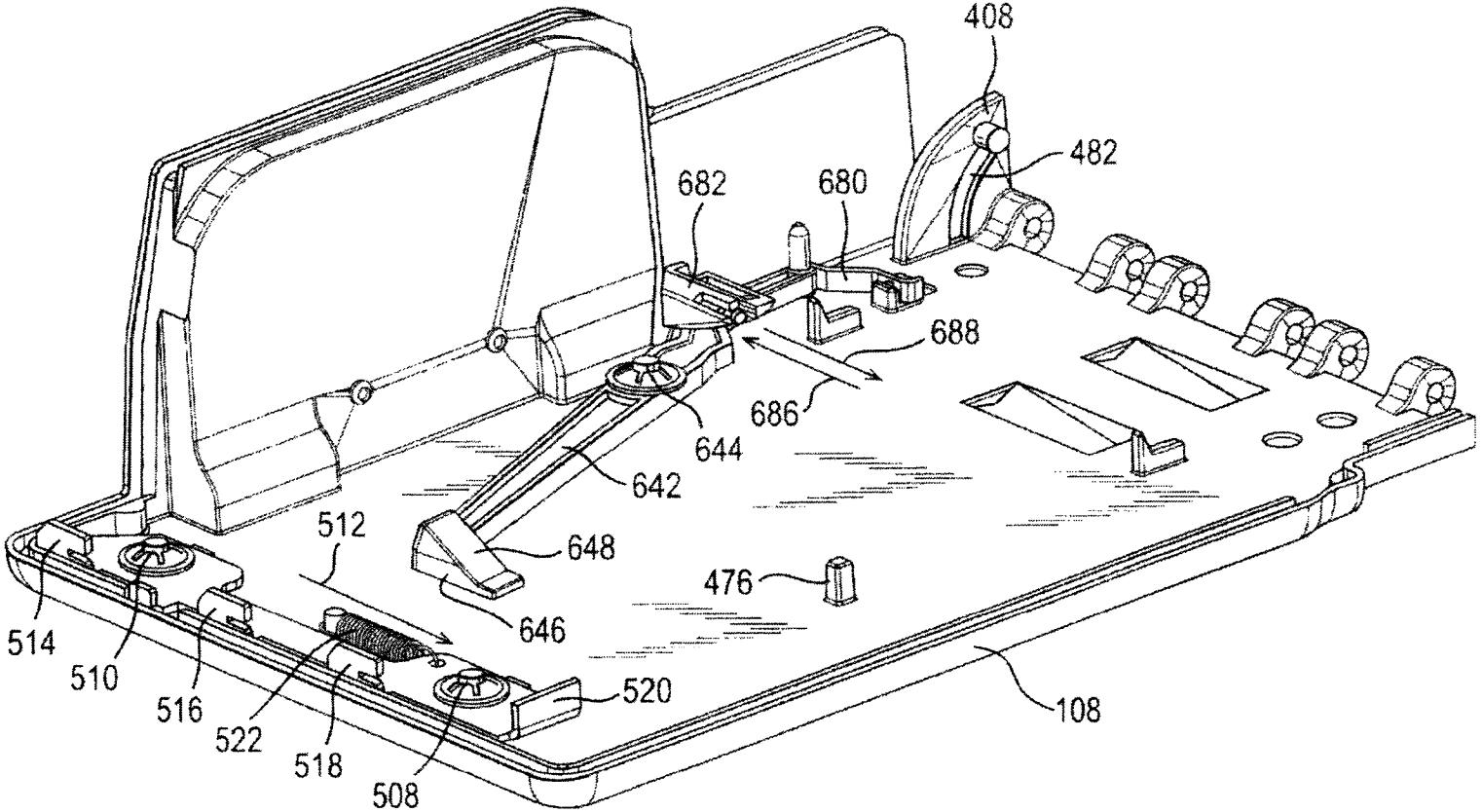
FIG. 12 is an isometric view of an underside of the lid of the banknote store of FIG. 2.

Internal chassis 140 includes a second void 474 located adjacent void 472, as illustrated in FIG. 10. FIG. 12 illustrates an underside of the lid 108 which includes a protrusion 476 which engages with void 474 of the internal chassis 140. Referring back to FIG. 10, first indicator surface 468 is shaped so that when the indicator is in its rest position, first indicator surface 468 blocks the complete insertion of the protrusion 476 of the lid 108 into the second void 474, thereby preventing the lid 108 from being completely closed.

The second indicator surface 470 is shaped so that when the indicator has moved to the operational position, the protrusion may be completely inserted into the second void 474, thereby allowing the lid to be closed.

In this manner, movement of the indicator between the rest position and the operational position (which is determined by the number of banknotes on the stack inserted into the store 100) determines whether the lid 108 can be closed or not and therefore whether the store can be secured. It is to be realised that in an alternative embodiment without the visual indicator provided to a user by the different colourings of the indicator surfaces 468 and 470, failure of the lid to close and/or lock (as described below) acts as an indicator to the user that there are too many banknotes in the stack.

Referring back to FIGS. 2 and 3, the store 100 includes a lock 500. The lock 500 includes a cam 502 rotatable within a holder 504 which is attached to the housing 102 of the store 100 and is operable by a suitable key.

The lid 108 (FIG. 12) includes a plate 506 attached thereto by screw and washer arrangements 508 and 510 so that the plate 506 can slide relative to the lid 108 in the directions of arrow 512. The plate includes three catches 514, 516 and 518 which move with the plate 506. Plate 506 also includes a protruding actuator 520.

When the lid 108 is closed, the protruding actuator 520 engages with the cam 502 of the lock 500 so that, when the cam 502 is rotated by a user, the action of the cam 502 on the protruding actuator 520 slides the plate 506 in the direction of arrow 512. Spring 522 encouraging the plate 506 in the opposite direction.

With reference to FIG. 3, the store 100 includes a locking plate 522 attached to the side wall 106. The locking plate includes flanges 524, 526 and 528. When the lid 108 is closed and plate 506 slides under action of the cam 502, the catches 514, 516 and 518 of the plate 506 will engage with respective flanges 514, 516 and 518, thereby locking the lid 108 to the side wall 106 and securing the housing 102.

When the stack contains too many banknotes for the lid 108 to be completely closed due to the interaction between the protrusion 476 of the lid 108 and the indicator 456, as previously described, the latches 514, 516 and 518 will not engage with the flanges 524, 526 and 528, thereby preventing the securing of the housing 102.

Figure 13:
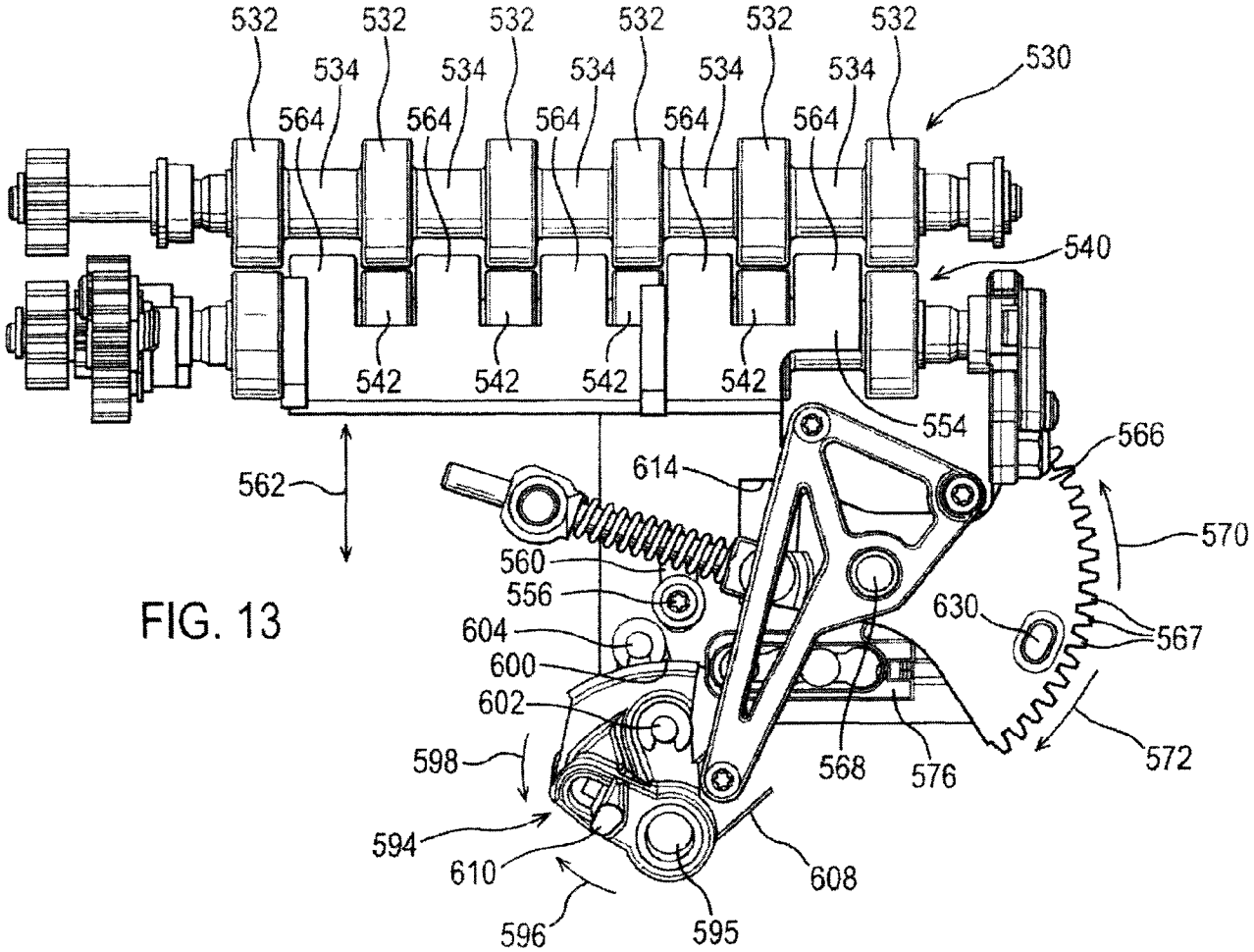
FIGS. 13 to 15 illustrate components used in the banknote store of FIG. 2.

FIG. 13 illustrates a detail of the store 100. Upper 530 and lower 540 free rollers are mounted to the internal chassis 140 (see FIG. 8 which illustrates the mounting of upper free roller 530, lower free roller 540 being mounted directly thereunder). A shutter 554 is slideably mounted to the inner surface of side wall 120 with screw and washer arrangements 556 and 558 interacting with void 560 formed in the shutter 554. The shutter is mounted so that it may move up and down, relative to the side wall 120 of housing 102, in the directions of arrow 562.

The aperture 122 in side wall 120 of housing 102 is partially defined by a bracket 560 located in the side wall 120 (FIG. 3) and is further defined by the upper 530 and lower 540 free rollers. Upper 530 and lower 540 rollers are formed with respective engaging surfaces 532 and 542 spaced from one another along respective axes 534 and 544. During the dispensing of banknotes, the engaging surfaces 532 and 542 will engage with banknotes dispensed from the store 10.

The spacing between engaging surfaces 532 and 542 of upper 530 and lower 540 free rollers provides gaps through which an intruder may insert objects in an attempt to access banknotes stored in the store 10. Therefore, shutter 554 is formed with projections 564 which, when the shutter is in an upper position, interleave with the upper 530 and lower 540 free rollers to block the aperture, the projections 564 filling the gaps between the engaging surfaces 532 and 542 of the upper 530 and lower 540 free rollers.

This acts as a security device, ensuring that unauthorised access to the store 100 is disallowed when the store is being transported. This is particularly effective in preventing "fishing" whereby a wire is inserted into an available aperture in an attempt to hook a banknote and extract it from the store.

Figure 14:
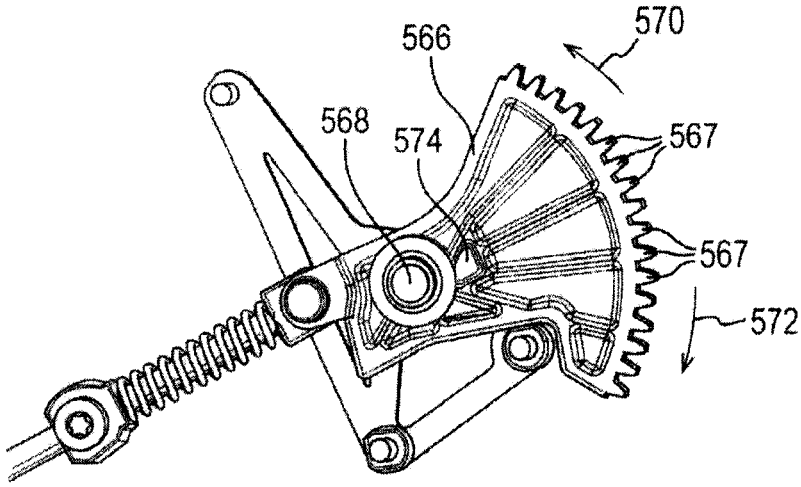

Also illustrated in FIG. 13 is a cog 566 having teeth 567 and pivotally mounted about point 568 so that the cog 566 is moveable in the direction of arrows 570 and 572. FIG. 14 illustrates the reverse side of cog 566 which includes a projection 574.

Figure 15:
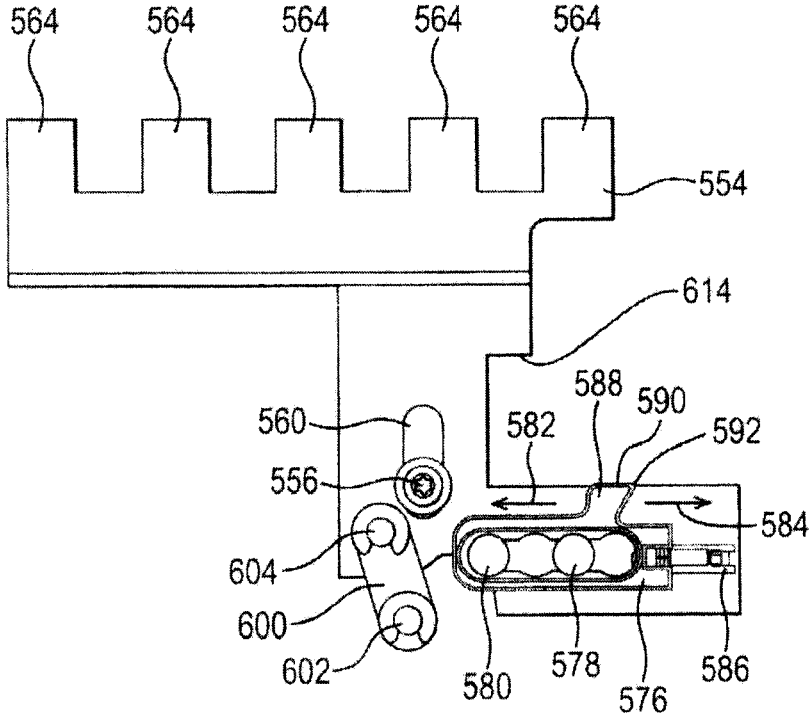

FIG. 15 is a view of shutter 554 and illustrates a sliding finger 576 mounted on the shutter 554 by pins 578 and 580. The finger 576 is slideably moveable with respect to the pins 578 and 580 in the direction of arrows 582 and 584. A spring 586, attached to finger 576 and to shutter 554, biases movement of the finger 576 in the direction of arrow 584. Finger 576 further includes a hook 588 having a level upper surface 590 and a ramped lower surface 592.

Referring back to FIG. 14, when cog 566 is moved in the direction of arrow 572, and the shutter 554 is in its upper position, the projection 574 will be rotated about point 568 and brought into contact with the ramped lower surface 592 of sliding finger 576, moving the finger in the direction of arrow 582. Because surface 592 is ramped, subsequent downwards movement of the shutter 554 will move finger 576 further in the direction of arrow 582. However, once projection 574 is out of engagement with hook 588 of the finger 576, the finger 576 will slide in the direction of arrow 584 under the action of spring 586 and engagement between projection 574 and upper level surface 590 of hook 588 will prevent the upwards movement of shutter 554 until projection 574 has been moved by rotation of cog 566 in the direction of arrow 570.

Referring to FIG. 13, a wedge 594 is mounted to the inner chassis 140 to allow rotational movement in the direction of arrows 596 and 598 about axis 595. A lever 600 connects wedge 594 to shutter 554 and is articulated about points 602 and 604. Therefore, movement of wedge 594 in the direction of arrow 598 will cause the lowering of shutter 554 and movement in the direction of arrow 596 will cause the raising of shutter 554. On the reverse side of wedge 594 to that illustrated in FIG. 13, a projection 606 of wedge 594 (illustrated in dotted outline) engages with a spring 608 (also illustrated in doted outline). Spring 608 encourages movement of wedge 594 in the direction of arrow 596 and therefore upwards movement of shutter 554.

Wedge 594 further includes a protruding member 610 which engages with an underside of the pressure plate 208 (FIG. 4). Downwards movement of the pressure plate 208 will cause the wedge 594 to rotate in the direction of arrow 598 which, in turn, causes downward movement of the shutter 554.

When the shutter 554 is in the upper position, downwards movement of the shutter 554 by action on the shutter 554 will be prevented by the alignment of lever 600 relative to the shutter 554 and the wedge 594 which will not translate linear force. However, rotational motion of the wedge 594 is readily translated into downwards motion of the shutter 554. As the shutter 554 blocks aperture 122 (FIG. 2) when in the upper position, the wedge 594 is not accessible from outside the store 100 without opening the lid 108 (for which a key is needed). Therefore shutter 554 serves to secure unauthorised access to the store 100 when in the upper position.

Also illustrated in FIG. 14, cog 566 includes a pin 612 which projects outwards. Shutter 554 includes a flange 614 (FIGS. 13 and 15) which is shaped so that, when the shutter 554 is in its upper position, the cog is free to rotate in the direction of arrows 570 and 572. However, when the shutter is in the lower position, engagement between the flange 614 and the projecting pin 612 prevents rotation of the cog 566 in the direction of arrow 570.

FIGS. 3 and 6 illustrate a cylinder 620 mounted for rotational movement relative to the housing 102 which includes an aperture 622 and a plurality of teeth 624 arranged around a portion of the circumference of the cylinder 620.

As described below, with reference to FIG. 22, the store 100 may be inserted into a banknote handler 800. Illustrated in FIG. 6, the printed circuit board 350 includes a connector 352 which, when the store 100 is inserted into a banknote handler, connects with the banknote handler. Processor 354 detects the connection.

The banknote handler includes an actuator 626 (shown in FIG. 3) shaped to engage with the aperture 622 of cylinder 620. The aperture 622 is formed as a helix so that when the actuator 626 is inserted into aperture 622, cylinder 620 rotates relative to housing 102.

Teeth 567 of cog 566 (FIGS. 13 and 14) engage with teeth 624 of cylinder 620 so that rotation of the cylinder 620 causes movement of the cog in the direction of arrows 570 and 572. The helical aperture 622 is formed so that insertion of the store 100 into the banknote handler will cause rotation of cylinder 620 in the direction of arrow 572 and extraction, in the direction of arrow 570.

So, when the store 100 is inserted into a banknote handler, engagement between the actuator 626 and the aperture 622 will cause rotation of the wedge 566 in the direction of arrow 572. This causes engagement between projection 574 and ramped lower surface 592 of sliding finger 576. Once the store 100 has been installed in the banknote handler, the processor 354 detects the installation and actuates motor 240 and will cause the pressure plate 208 to move downwards during an initialisation phase. This causes the shutter 554 to move downwards, thereby opening aperture 122, readying the store 100 for the dispensing of the banknotes stored therein.

As banknotes are dispensed from the store 100, the pressure plate 208 will move upwards under the action of spring 230. Shutter 554 will then move upwards under the action of spring 608 until level upper surface 590 of hook 588 of finger 576 is brought into engagement with projection 574 of wedge 566, which will arrest further upward movement of shutter 554.

When the store 100 is extracted from the banknote handler, engagement between the actuator 626 and the aperture 622 will cause rotation of the wedge 566 in the direction of arrow 570. This will bring projection 574 out of engagement with the finger 576 and the shutter 554 will continue its upward movement under the action of spring 608 until aperture 122 is closed.

If the shutter cannot close if, for example, a banknote has become stuck in aperture 122 during a dispensing operation, engagement between protruding pin 612 of wedge 566 and flange 614 of shutter 554 will prevent rotation of the wedge 566 in the direction of arrow 570. This, in turn will prevent rotation of cylinder 620 relative to actuator 626 thereby preventing the removal of the store 100 from the banknote handler in this manner.

Removal of the store 100 from the banknote handler is then carried out, in a different manner, by accessing the banknote handler and manually rotating the actuator 626. This is advantageous as different people, with different degrees of trust, can be tasked with removal of the store 100 from the banknote handler by extraction and by accessing the banknote handler.

Figure 16:
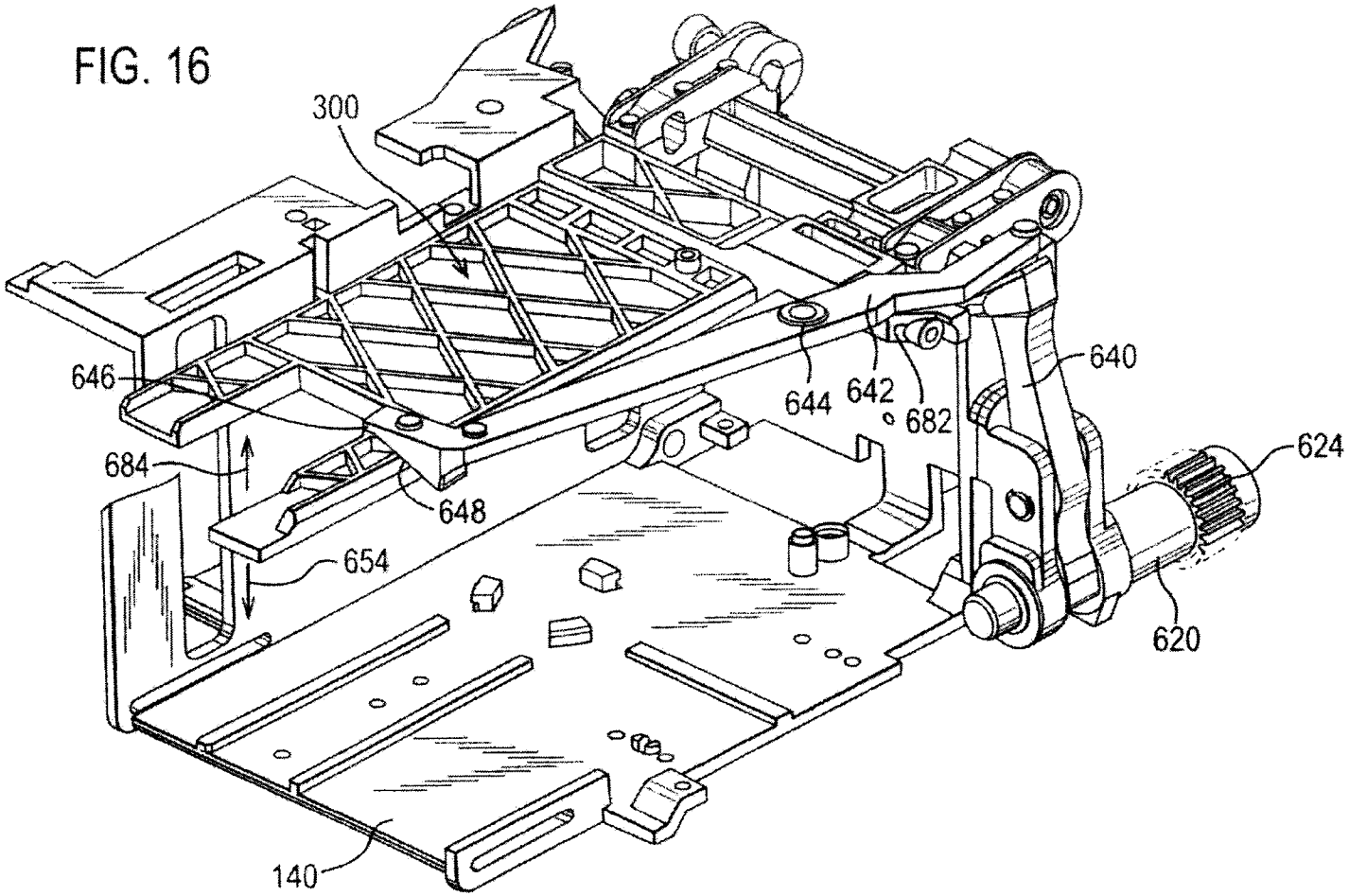
FIG. 16 is an isometric view of a detail of the banknote store of FIG. 2.

FIG. 16 illustrates internal chassis 140 and plate 300. Cylinder 620 is connected to an arm 640 which in turn is connected to a lever 642 mounted to the internal chassis 140 for pivotal movement about pin 644. Lever 642 includes a flange 646 having a ramped surface 648.

FIG. 12 illustrates the position of lever 642 relative to the lid 108. Leaf spring 680 encourages movement of lever 642 in the direction causing engagement between the ramped surface 648 and the plate 300 (as described below). A linear cam 682 is mounted to the internal chassis 140 and is moveable in the directions of arrows 686 and 688. As illustrated in FIG. 7, plate 300 includes a surface 690 with which the linear cam 682 interacts. When the linear cam 682 moves in direction of arrow 688, the plate 300 will be encouraged to move upwards in the direction of arrow 684 (FIG. 16). Lever 640 also interacts with linear cam 682 causing movement of the cam in the direction of arrow 686 (thereby causing it to disengage with the plate 300).

Rotation of cylinder 620 causes movement of arm 640 so that lever 642 pivots about pin 644. The pivoting of arm 644 brings ramped surface 648 of flange 646 into and out of engagement with plate 300. As illustrated in FIG. 7, plate 300 includes a complimentary ramped surface 650 and free roller 652. The ramped surface 648 of lever 642 engages with the plate 300 between ramped surface 650 and free roller 652.

Cylinder 620 is rotated by insertion of the store 100 into a banknote handler (as previously described) and rotated in the opposite direction by extraction. Inserting will cause the cylinder to actuate the lever 640 so that the lever 642 is moved out of engagement with the plate 300 under the action of spring 680. Simultaneously, linear cam 682 will move in the direction of arrow 688, thereby lifting the plate 300 in the direction of arrow 684 (FIG. 16). Extraction will cause engagement between lever 642 and plate 300 and cause linear cam 682 to move out of engagement with plate 300, thereby causing downwards movement of plate 300.

The uptake roller is mounted relative to the plate 300 so that it floats. In other words, a certain amount of movement of the uptake roller 302 in the up and down directions (with reference to the Figures) is permitted. When more than a single banknote has been removed from the stack and banknotes are returned to the stack in the manner previously described, free motion of the uptake roller 302 reduces the friction between the uptake roller 302 and the returning banknotes.

To accommodate this free motion of the uptake roller 302, the plate 300 is allowed a certain freedom of movement once locked in place. In the embodiment illustrated, this freedom is six degrees of rotation relative to the housing 102 of the store 100. To prevent movement of the stack during transport, the plate 300 must be locked down which is achieved by interaction between the ramped surface 648 of lever 642 and complimentary ramped surface 650 of plate 300 which, due to appropriate rotation of cylinder 620, is caused by extraction of the store 100 from a banknote handler.

Likewise, insertion through the action of cylinder 620 will cause the linear cam 682 to engage with the plate 300 and lever 642 to disengage with the plate 300 allowing the free movement of uptake roller 302 during dispensing operations.

Referring back to FIG. 13, wedge 566 further includes a protrusion 630 located near the rim of the wedge 566. As previously described, with reference to FIG. 5, downwards movement of the pressure plate 208 is prevented when the serrated surface of abutment 274 is brought into engagement with the serrated surface 276 of the reciprocating plate 228. Arm 270 includes an actuator 278. When wedge 566 moves in the direction of arrow 572, protrusion 630 is brought into contact with actuator 278, causing arm 270 to pivot about pin 272, moving the serrated surface of abutment 274 away from serrated surface 276 of reciprocating plate 228. Therefore insertion of the store 100 into the banknote handler allows free movement of the pressure plate 208.

When the store 100 is removed from the banknote handler by extraction, the arm 270 is free to pivot back as the protrusion 630 of wedge 566 has moved in the direction of arrow 570. The arm 270 includes a spring (not shown) encouraging this reverse movement thereby locking the pressure plate 208 by preventing movement of the pressure plate 208.

Illustrated in FIG. 11, lever 484 joining lid 108 to second front lever 204 includes an actuator 660 having a ramped surface 662. As the lid 108 is opened and closed, actuator 660 will move up and down in the directions of arrow 664 (opening of the lid 108 causing upward movement, closing causing downward movement).

Arm 270 (FIG. 5) includes a formation 666 which engages with the ramped surface 662 of actuator 660. Therefore, when the lid 108 is opened, actuator 660 will engage with formation 660, causing arm 270 to pivot, disengaging serated surfaces 274 and 276, thereby unlocking pressure plate 208.

Void 488 in lever 484 and void 482 in actuator 480 of lid 108 ensure that opening of the lid 108 does not lower the pressure plate 208 before the pressure plate 208 has been unlocked by the action of actuator 660.

As illustrated in FIGS. 5 and 6, the store 100 includes a cog 286 mounted to rod 260 and which can pivot relative thereto. Cog 286 is joined to second back lever 216 by pin 288. Therefore, as the second back lever 216 pivots about rod 260 as the pressure plate 208 moves up and down, so too will the cog 286 pivot about rod 260.

Figure 17:
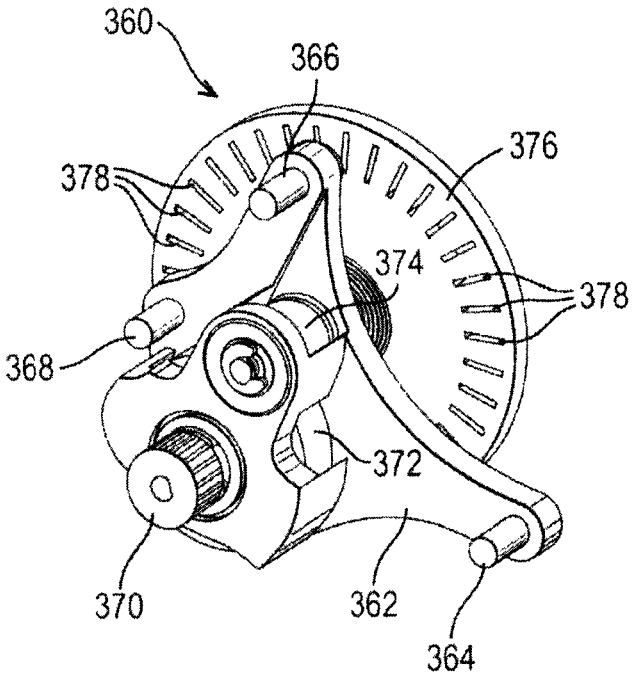
FIGS. 17 to 19 illustrate components used in the banknote store of FIG. 2.

Cog 286 engages with a height detector 360 illustrated in greater detail in FIG. 17. Height detector 360 includes a frame 362 connected by pins 364, 366 and 368 to the internal chassis 140. Segmented cog 370 is mounted for rotational movement to the frame 362 and is connected to friction wheel 372. Friction wheel 372 engages with friction wheel 374 which is attached to coding wheel 376. Coding wheel 376 includes a number of apertures 378.

As cog 286 pivots about rod 260, it engages with and rotates segmented cog 370. Rotation of cog 370 causes the rotation of friction wheel 372 which, in turn, causes the rotation of friction wheel 374, thereby rotating coding wheel 376.

Figure 18:
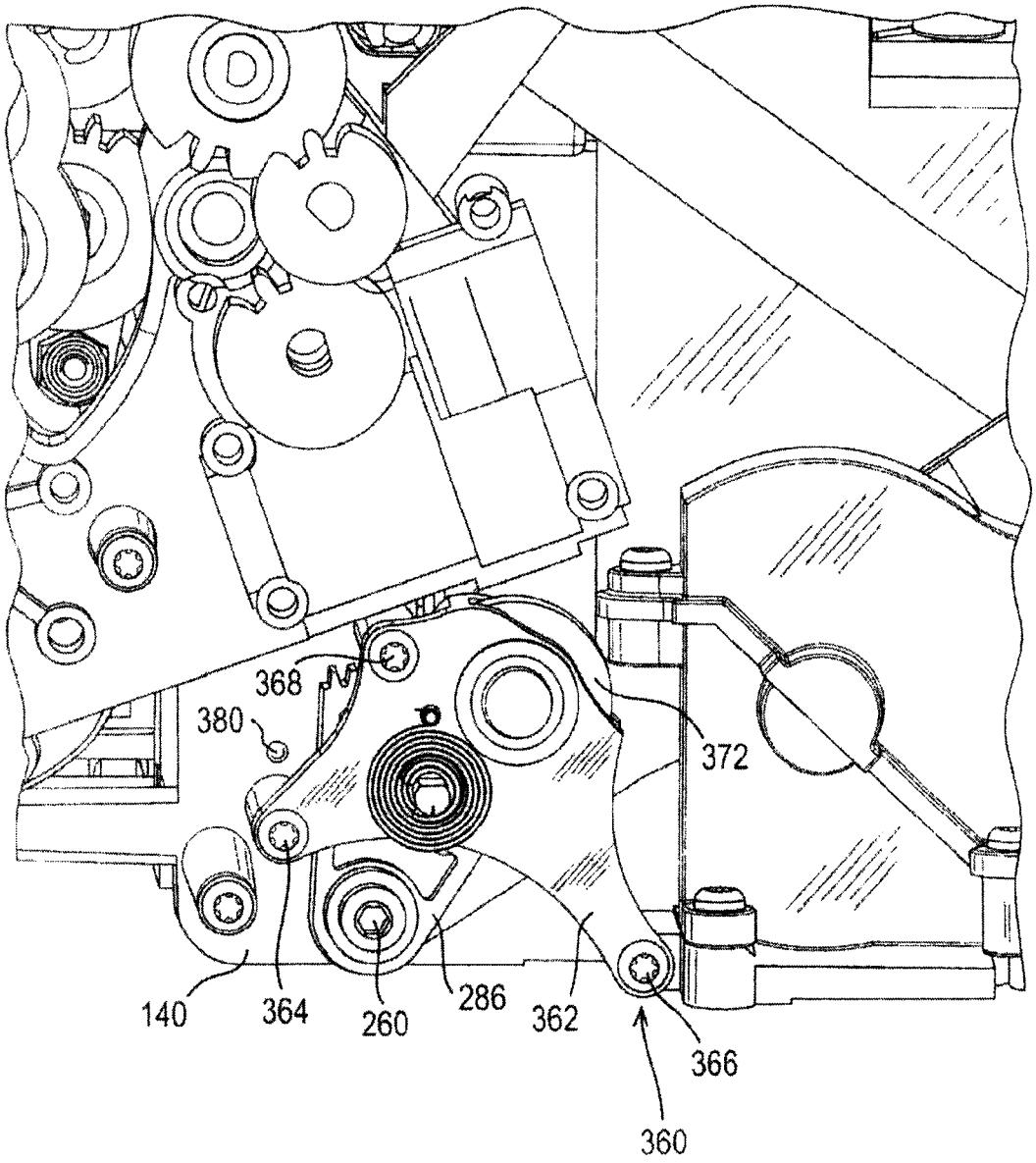
Figure 19:
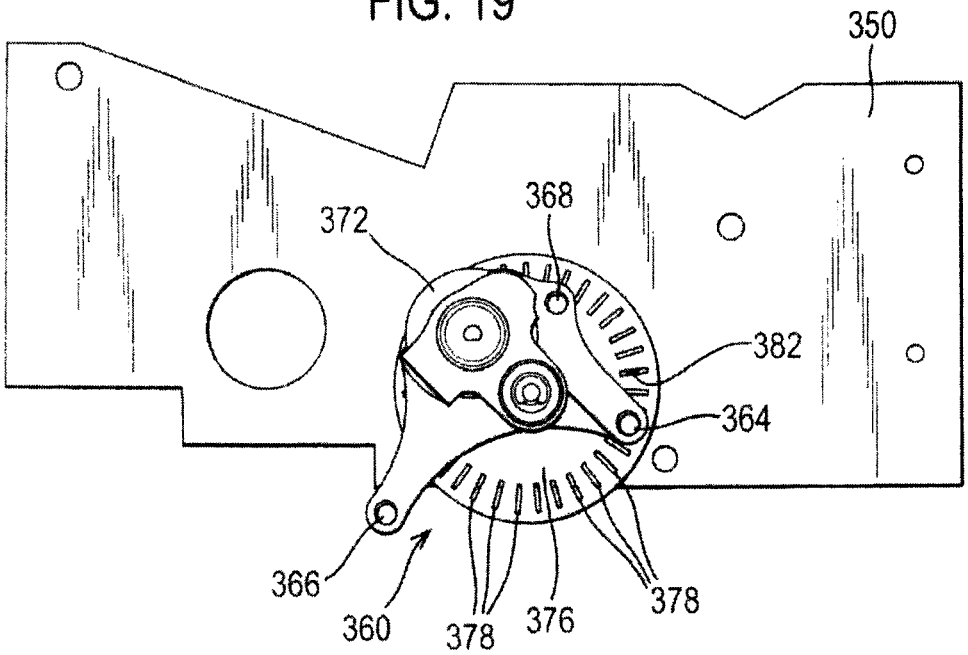

FIG. 18 illustrates the frame 362 of the height detector 360 mounted to internal chassis 140. The internal chassis 140 includes a light source in the form of an LED 380. FIG. 19 illustrates the mounting of the height detector 360 relative to the printed circuit board 350 which includes a sensor 382 connected to the processor 354.

The LED 380 and the sensor 382 are mounted so that the sensor 382 receives light emitted by the LED 380 through the apertures 378 of the coding wheel 376. Rotation of the coding wheel 376 causes intermittent occlusion of the light beam emitted by LED 380.

When the store 100 is inserted into a banknote handler (as described below), the processor 354 initiates an initialisation sequence whereby the motor 240 (FIG. 6) is actuated and causes the lowering of the pressure plate 208 to the lowest possible position. As described, this will lower the shutter 554. As the pressure plate 208 moves upwards under the action of spring 230, coding wheel 376 will rotate, causing the intermittent occlusion of the light emitted by LED 380.

Upwards movement of the pressure plate 208 will discontinue when the topmost banknote of the stack resting on the pressure plate 208 comes into contact with plate 300. Once the pressure plate 208 has ceased moving, the processor 354 counts the number of times which the light falling on sensor 382 has been occluded. The processor compares the measured number of occlusions to the number of occlusions of the light beam which would occur if there were no banknotes (which is stored in memory, not shown). The processor is thereby able to measure the relative height of the stack of banknotes resting on pressure plate 208 when the store 100 is first inserted into the banknote handler 800.

The memory of the processor 830 may also store the maximum height of a banknote stack which may rest on the pressure plate 208 and, by comparing this to the measured number of occlusions, calculate the height of the stack.

A user can instruct processor 354, by the appropriate programming of software included on the processor 354, to repeat the process described above at any time to report the height of the stack of banknotes stored by the store 100, or the processor 354 can be programmed to repeat this processes at predetermined intervals. The store 100 includes a network connection in the form of a wireless radio integrated with printed circuit board 350. The processor 354 thereby reports the height of the stack of banknotes stored by the store 100 to the user so that the user can refill the store (or replace it with a pre-filled store) when deemed necessary.

Banknotes, even those of the same denomination and currency, vary in thickness, depending on their age. However, the calculated height of the banknote stack provides a reasonable estimation of the number of banknotes stored in the store 100.

Figure 20:
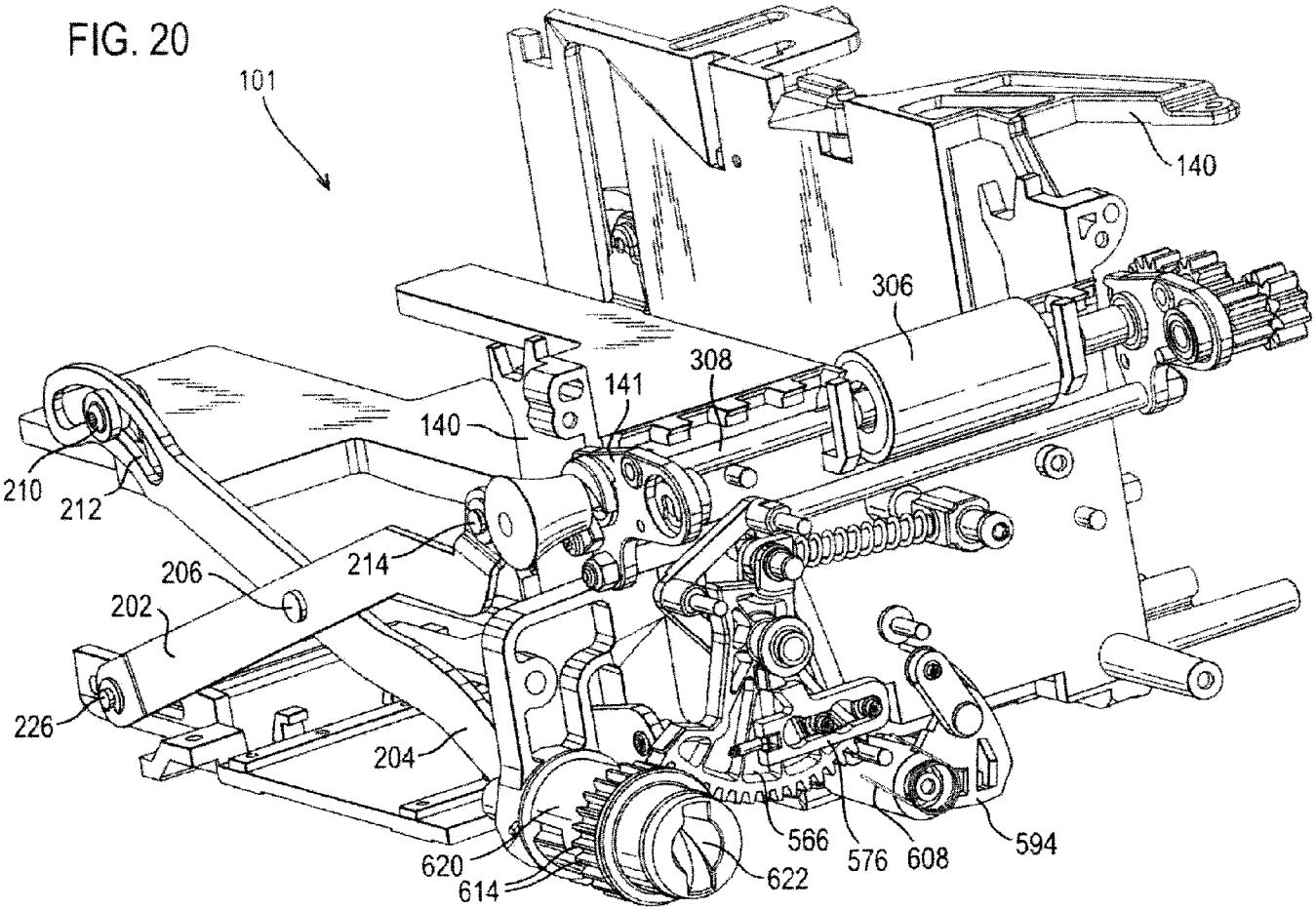

FIG. 20 illustrates a alternative embodiment of a banknote store 101 according to the invention. Like numerals are used to designate like components. The banknote store 101 includes a lower transport roller 306 mounted for rotation on shaft 308 relative to a support frame 141 which is attached to internal chassis 140 in a similar location and in a similar manner to the lower transport roller 306 of banknote store 100 as illustrated, for example in FIG. 7.

The lower transport roller 306, as previously described with reference to banknote store 100, acts to transport banknotes out of the store 101 and to return banknotes to the store if more than a single banknote has been removed from the stack. Therefore this lower transport roller 306 undergoes a significant amount of wear and tear and will have to be replaced. Due to the placement of this roller, it is not easily accessible.

Figure 21:
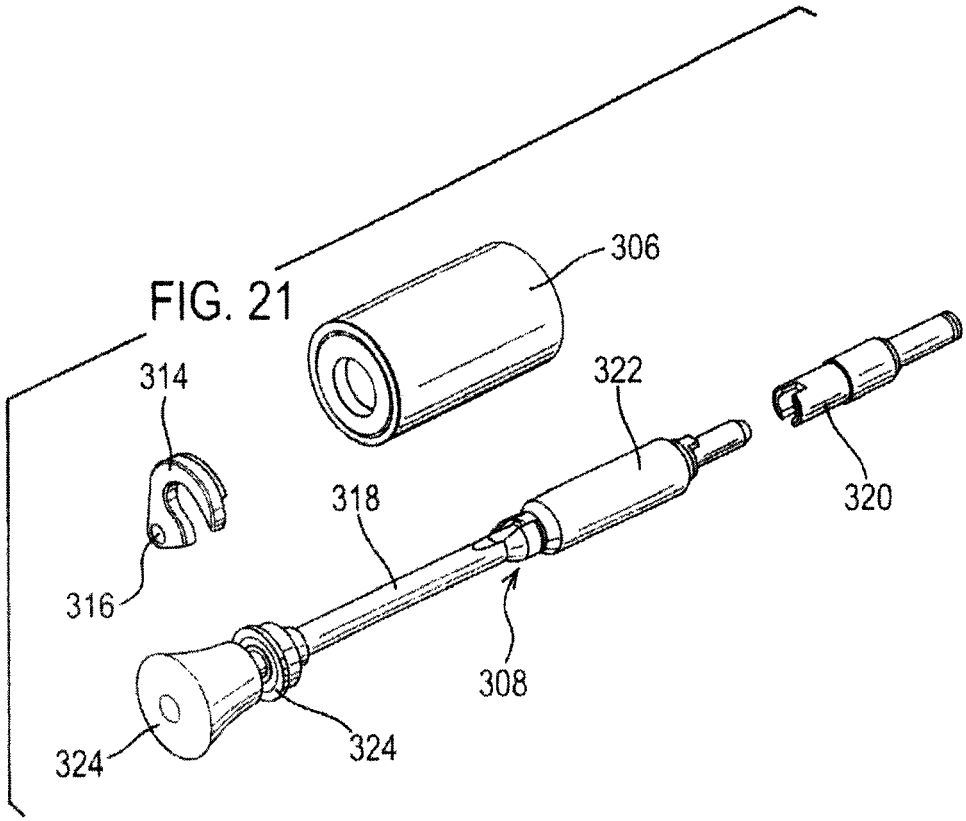
FIGS. 20 and 21 illustrate components of a banknote store according to a further preferred embodiment of the invention

Referring to FIG. 21, which is a view of the roller 306 and shaft 308, showing the various components displaced from one another. A lever 314 is attached to the support frame 141 for articulation about point 316. Shaft 308 consists of a first portion 318 and a second portion 320. The first portion 318 furthermore includes an engagement shaft 322 which is shaped to engage with the roller 306 and ensures that the roller 306 rotates with the shaft 308. In the embodiment shown, the engagement shaft 322 includes a tongue (not shown) which engages with a grove in the roller 306 (not shown). Shaft 308 includes a knob 324 and a pulling action on the knob 324 will cause the first portion 318 of shaft 308 to separate from the second portion 320, as illustrated in FIG. 21. Lever 314 engages with the shaft 308 between knob 324 and stop 324 so that, when the lever 314 is in place, movement of the first portion 318 relative to the second portion 320 of shaft 308 is prevented.

When a user wishes to change the roller 306, the lever 314 is moved about point 316 and the shaft 308 is pulled by action on knob 324 to separate the first portion 318 from the second portion 320. Further pulling action on knob 324 will separate the first 318 and second 320 portions sufficiently so that the roller 306 will disengage from the engagement shaft 322 and will fall down into the interior of the banknote store 101 where it may be retrieved. A replacement roller can then be inserted into the space so vacated and the first portion put back into position by pushing action on the knob 324 (and, if required, rotation of the first portion 318, to ensure engagement with the replacement roller). Once the first portion 318 is back in position, the lever 314 is moved back into position and the replacement roller is ready to be used.

Because the shaft cleaves to allow removal of the roller 306, this roller may be replaced without having to disassemble major parts of the banknote store 101, thereby improving the ease with which this roller may be replaced.

Figure 22:
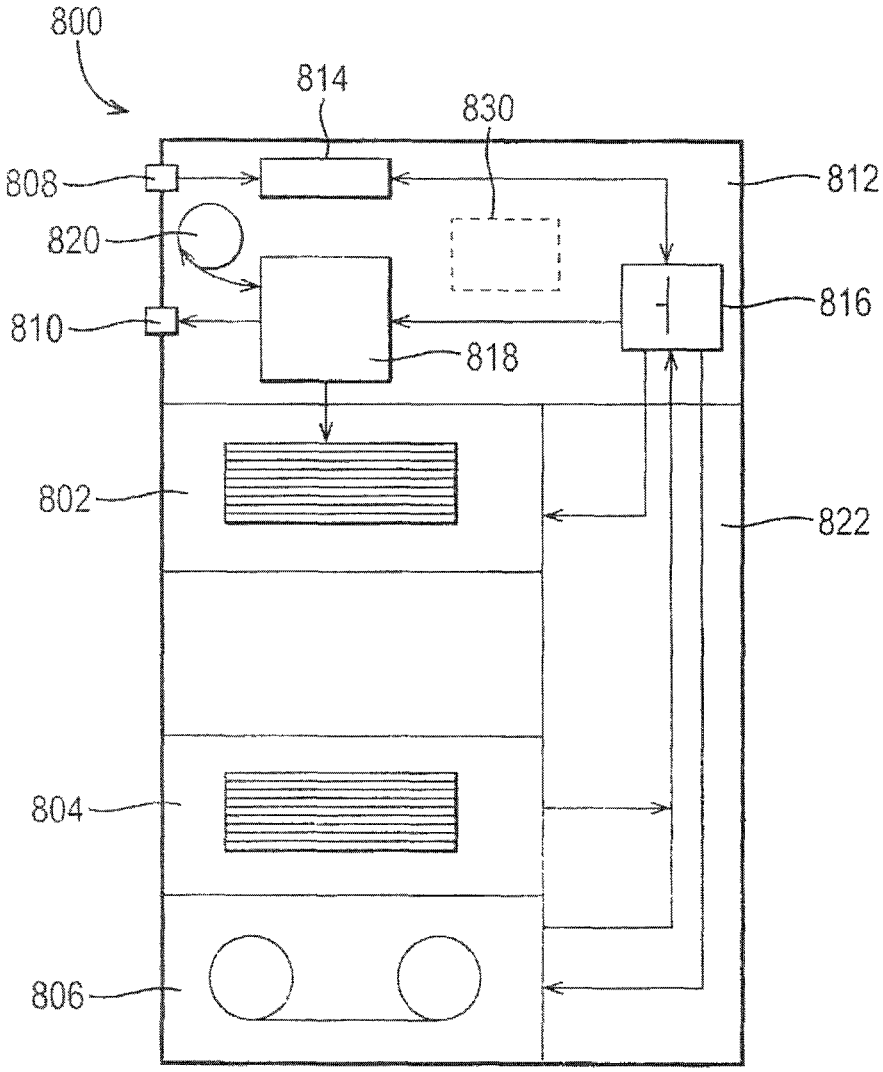
FIG. 22 is a schematic diagram of a banknote handler.

FIG. 22 illustrates a banknote handler 800 which includes a number of banknote stores: a cashbox 802 which receives and stores banknotes; a payout 804 which stores and dispenses banknotes as they are required; and a recycler 806 which receives, stores and dispenses banknotes. The banknote handler 800 is further provided with an input 808 into which a user inserts banknotes and an output 810 from which banknotes are dispensed to a user.

A head portion 812 includes a banknote authenticator 814 which verifies the authenticity of banknotes inserted by a user and banknotes dispensed from the payout 804 and from the recycler 806. A gate 816 redirects banknotes according to a desired destination. A diverter 818 directs banknotes to a bundler 820, to the output 810, or the cashbox 802, as desired.

A spine portion 822 couples to the cashbox 802, the payout 804 and the recycler 806. The head portion 812 and the spine portion 822 include rollers and other transport means (not shown) known in the art for transporting banknotes in the directions of the arrows illustrated. The spine portion 822 therefore acts as a banknote transporter.

A central processor 830 is connected to the cashbox 802, payout 804 and recycler 806 and controls the operations of these banknote stores, determining when banknotes are dispensed or stored. The processor 830 also controls the operation of the authenticator 814, the gate 816, the diverter 818, the bundler 820 and the various rollers and transport means to control the authentication, bundling and transport of banknotes in the banknote handler.

It will be realised that the banknote store 100 illustrated in FIGS. 2 to 19 is analogous to payout 804 illustrated in FIG. 22. The spine portion 822 of banknote handler 800 includes an actuator 626 (FIGS. 2 and 3) which engages with the store 100 in the in the manner described above. The spine portion also includes an electrical connector (not shown) which mates with the connector 352 of the stores 100. Thereby the processor is connected to the processor 830 and the dispensing of banknotes, and other functions, described above are carried out under the control of the processor 830 of the banknote handler 800.

What is claimed is:

1. A value sheet store comprising: a housing having an aperture from which the value sheets are dispensed, said aperture at least partially defined by a roller; and a shutter formed to interleave with the roller and operable to block the aperture.

2. A value sheet store according to claim 1 wherein the shutter is formed to interleave with the aperture to block the aperture.

3. The value sheet store according to claim 1 adapted to be removably engageable with a value sheet transporter for transporting value sheets to or away from the store.

4. The value sheet store according to claim 3 comprising means to move the shutter so that the shutter blocks the aperture when the store and the transporter are not engaged and moves the shutter to unblock the aperture when the store and the transporter are engaged.

5. A value sheet handler comprising:

a value sheet store comprising: a housing having an aperture from which the value sheets are dispensed, said aperture at least partially defined by a roller; a shutter formed to interleave with the roller and operable to block the aperture; and a value sheet transporter.

6. The value sheet handler according to claim 5 further comprising an engaging member coupled to the shutter and the value sheet handler, said engaging member configured to prevent removal of the store from the value sheet handler unless the shutter blocks the aperture.

7. The value sheet handler according to claim 6 further comprising a manual override so that the store may be removed regardless of the shutter position.

* * * * *